US008003874B2

(12) United States Patent
Asakura et al.

(10) Patent No.: US 8,003,874 B2
(45) Date of Patent: Aug. 23, 2011

(54) PORTABLE CHORD OUTPUT DEVICE, COMPUTER PROGRAM AND RECORDING MEDIUM

(75) Inventors: Kosuke Asakura, Tokyo (JP); Seth Delackner, Tokyo (JP)

(73) Assignee: Plato Corp., Tokyo (JP)

( * ) Notice: Subject to any disclaimer, the term of this patent is extended or adjusted under 35 U.S.C. 154(b) by 0 days.

(21) Appl. No.: 12/307,309

(22) PCT Filed: Jul. 3, 2007

(86) PCT No.: PCT/JP2007/063630

§ 371 (c)(1),
(2), (4) Date: Nov. 16, 2009

(87) PCT Pub. No.: WO2008/004690

PCT Pub. Date: Jan. 10, 2008

(65) Prior Publication Data

US 2010/0294112 A1 Nov. 25, 2010

(30) Foreign Application Priority Data

Jul. 3, 2006 (JP) ..... 2006-183775

(51) Int. Cl.
*G10H 1/38* (2006.01)
*G10H 7/00* (2006.01)

(52) U.S. Cl. ..... 84/613

(58) Field of Classification Search ..... 84/613, 84/637, 669

See application file for complete search history.

(56) References Cited

U.S. PATENT DOCUMENTS

| | | | | |
|---|---|---|---|---|
| 4,480,521 | A * | 11/1984 | Schmoyer | 84/715 |
| 4,781,099 | A * | 11/1988 | Koike | 84/470 R |
| 5,440,071 | A * | 8/1995 | Johnson | 84/637 |
| 6,111,179 | A * | 8/2000 | Miller | 84/442 |
| 6,188,008 | B1 * | 2/2001 | Fukata | 84/470 R |
| 7,161,080 | B1 * | 1/2007 | Barnett | 84/613 |
| 7,420,114 | B1 * | 9/2008 | Vandervoort | 84/613 |
| 2007/0240559 | A1 * | 10/2007 | Hasebe | 84/637 |
| 2008/0173161 | A1 * | 7/2008 | Schwartz | 84/637 |
| 2009/0173216 | A1 * | 7/2009 | Gatzsche et al. | 84/613 |

FOREIGN PATENT DOCUMENTS

| | | |
|---|---|---|
| JP | 04-260098 | 9/1992 |
| JP | 07-044172 | 2/1995 |
| JP | 08-190336 | 7/1996 |
| JP | 09-034392 | 2/1997 |
| JP | 2000-148168 | 5/2000 |
| JP | 2003-263159 | 9/2003 |
| JP | 2004-240077 | 8/2004 |
| JP | 2005-078046 | 3/2005 |

OTHER PUBLICATIONS

International Search Report Dated Aug. 21, 2007. English language Abstracts of JP 04-260098, JP 07-044172, JP 08-190336, JP 09-034392, JP 2000-148168, JP 2003-263159, JP 2004-240077, JP 2005-078046.

* cited by examiner

*Primary Examiner* — Jeffrey Donels
(74) *Attorney, Agent, or Firm* — Bachman & LaPointe, P.C.

(57) ABSTRACT

To provide a portable chord producing device capable of producing chord sounds by a simple operation.

In or on a housing 10 of a portable size, an operation switch 121 with which eight different chord sounds can be designated, and a display screen 11 which also serves as a touch sensor panel are formed. A memory card 20 has a chord data file recorded thereon that is used for letting chord sounds that have characteristics of sounds on a real musical instruments be produced. The chord producing device produces the chord sounds designated by the operation switch 121 through a sound production mechanism in a manner that is associated with a specific touch operation only during the time when it is selected.

12 Claims, 16 Drawing Sheets

CHECK CHORD SETTINGS

| SELECTION SWITCH | FIELD |
|---|---|
| # 1 | MUSIC TUNE # 1 |
| # 2 | MUSIC TUNE # 2 |
| # 3 | MUSIC TUNE # 3 |
| # 4 | MUSIC TUNE # 4 |
| USER SETTING 1 | No.1 |
| USER SETTING 2 | No.2 |
| USER SETTING 3 | No.3 |
| USER SETTING 4 | No.4 |

(a)

EXTENDED SWITCH OFF/SELECTION SWITCH #1

| # 1 | # 2 | # 3 | # 4 | # 5 | # 6 | # 7 | # 8 |
|---|---|---|---|---|---|---|---|
| Am | Dm | F | Bm | G7 | G | C | Em |

EXTENDED SWITCH ON/SELECTION SWITCH #1

| # 1 | # 2 | # 3 | # 4 | # 5 | # 6 | # 7 | # 8 |
|---|---|---|---|---|---|---|---|
| A | D | Fm | B | Gm | Gm | Cm | E |

(b)

EXTENDED SWITCH OFF/SELECTION SWITCH #2

| # 1 | # 2 | # 3 | # 4 | # 5 | # 6 | # 7 | # 8 |
|---|---|---|---|---|---|---|---|
| Cm | Fm | G # | Dm | A#7 | A # | D # | Gm |

EXTENDED SWITCH ON/SELECTION SWITCH #2

| # 1 | # 2 | # 3 | # 4 | # 5 | # 6 | # 7 | # 8 |
|---|---|---|---|---|---|---|---|
| C | F | G#m | D | A#m | A#m | D # | Gm |

(c)

EXTENDED SWITCH OFF/SELECTION SWITCH #3

| # 1 | # 2 | # 3 | # 4 | # 5 | # 6 | # 7 | # 8 |
|---|---|---|---|---|---|---|---|
| Em | Am | C | F#m | D7 | D | G | Bm |

EXTENDED SWITCH ON/SELECTION SWITCH #3

| # 1 | # 2 | # 3 | # 4 | # 5 | # 6 | # 7 | # 8 |
|---|---|---|---|---|---|---|---|
| E | A | Cm | F # | Dm | Dm | Gm | B |

FIG.8

| | | |
|---|---|---|
| c10100 (Am) | c101001 | AM DATA FIRST DIRECTION LEVEL 1 |
| | c101002 | AM DATA FIRST DIRECTION LEVEL 2 |
| | c101003 | AM DATA FIRST DIRECTION LEVEL 3 |
| | c101004 | AM DATA SECOND DIRECTION LEVEL 1 |
| | c101005 | AM DATA SECOND DIRECTION LEVEL 2 |
| | c101006 | AM DATA SECOND DIRECTION LEVEL 3 |
| ... | ... | ... |
| c10101 (Bm) | c101011 | BM DATA FIRST DIRECTION LEVEL 1 |
| | c101012 | BM DATA FIRST DIRECTION LEVEL 2 |
| | c101013 | BM DATA FIRST DIRECTION LEVEL 3 |
| | c101014 | BM DATA SECOND DIRECTION LEVEL 1 |
| | c101015 | BM DATA SECOND DIRECTION LEVEL 2 |
| | c101016 | BM DATA SECOND DIRECTION LEVEL 3 |
| ... | ... | ... |
| c1011 (Dm) | c101101 | DM DATA FIRST DIRECTION LEVEL 1 |
| | c101102 | DM DATA FIRST DIRECTION LEVEL 2 |
| | c101103 | DM DATA FIRST DIRECTION LEVEL 3 |
| | c101104 | DM DATA SECOND DIRECTION LEVEL 1 |
| | c101105 | DM DATA SECOND DIRECTION LEVEL 2 |
| | c101106 | DM DATA SECOND DIRECTION LEVEL 3 |
| ... | ... | ... |
| ... | ... | ... |
| | ... | ... |
| | ... | ... |

FIG.9

PORTABLE CHORD OUTPUT DEVICE, COMPUTER PROGRAM AND RECORDING MEDIUM

TECHNICAL FIELD

This invention relates to a portable chord producing device and a related product that can simulate the chord timbres of real musical instruments such as guitars and pianos under the player's control.

BACKGROUND ART

Development of sound processing and other information processing technologies has provided electronic musical instrument devices that simulate the timbre of real musical instruments using electronics. Electronic musical instrument devices of the type described are made up of, for example, a housing that mimics the contours of a real musical instrument, a plurality of sensors, a sound producing unit and a control unit. The sensors are provided at positions where a player is to touch, and produce a predetermined data in response to a detection of a certain operation by the player. The control unit stores a program and a data for producing musical sounds. It generates a sound source data according to the sensor output (s) and makes a sound producing unit which includes a speaker produce it.

Some electronic musical instrument devices have a display unit such as light-emitting elements or a display screen. In such an electronic musical instrument device, an operating procedure is successively provided on the display unit, and the player operates the device and provides an input to the device according to the procedure, thereby to make the device produce musical sounds similar to those produced by a real musical instrument. In addition, some electronic musical instrument devices have lyrics appear on screen as in the case of "karaoke". More specifically, lyrics data which is associated with operation instruction data representing what the player should operate is stored on a memory within the device. When producing the lyrics data on the display unit, the operation instruction data is also produced thereon along with it, to link the display of the lyrics with what the player should operate.

As apparent from the aforementioned example, conventional electronic musical instrument devices have an advantage that musical sounds can be produced at low costs in place of expensive real musical instruments or karaokes. In addition, these electronic musical instrument devices can be operated easily to play even by a person who cannot play a real musical instrument when he or she can learn unique operating procedures of the device.

Music is not of the kind that cannot be enjoyed unless you can play a musical instrument well. Music is familiar. Taking a guitar as an example, you can enjoy music easily anywhere as long as you can play chords even when you cannot play melodies regardless of whether you are alone or in flocks. However, there are many different chords and it is hard to learn them. For example, chords using three notes are C, Dm, Em, F, G, Am, Em, etc. Chords using four notes are Cmaj7, Dm7, Em7, Fmaj7, G7, Am7, Bm7flat5 etc. Some chords are triads or tetrads with an added note such as the note nine or eleven scale degrees from the root of a chord. Furthermore, you can use different chord forms to play a guitar depending on where to position your fingers on the fingerboard. That is, in the case of the C chord, the fingering at the low position is different from the fingering at the high position or the fingering at the middle position between them. Some attempts have been made to show proper fingering for these enormous amounts of chords on apiece of paper for each musical composition. However, paper products themselves are bulky and not easy for handling. In addition, usability is bad because it is necessary to flip pages in order to know a fingering position for a specific desired chord.

In the aforementioned conventional electronic musical instrument device, chord data may previously be prepared and an expected configuration is that the device directs the player to provide operation inputs for the chords. However, the player is inconveniently required to learn details of the operation to produce chord sounds if this is intended to be achieved by using an electronic musical instrument device having no display screen. Even using an electronic musical instrument device having a display screen, a lot of skill is required for the operation because an operation instruction for the chords should be entered according to the device-driven display progress. In an electronic musical instrument device such as a karaoke, the operation instruction cannot be entered at a singer's own pace. Therefore, it is impossible to sing an identical song slowly or at a quick tempo depending on the mood at a given time. In addition, it is impossible to play a musical instrument and sing a song at the same time.

In addition, in the conventional electronic musical instrument devices, only predetermined musical sounds are produced once the player has learned how to operate the device. Accordingly, skilled players are less and less attracted to the device and will eventually get bored.

These problems are common not just to guitars but to small electronic musical instrument devices that electronically produce sounds of other real musical instruments such as a piano capable of producing the chord sounds.

An object of the present invention is to provide a portable chord producing device which a player can play easily and freely at his or her own pace anywhere, regardless of the level of his or her skill and which allows the player to play the device and sing a song at the same time and to accompany many fellows singing in chorus, under the player's control.

SUMMARY OF THE INVENTION

A chord producing device according to the present invention has a housing of a portable size, the housing having a plurality of manipulators formed thereon each of which can be selected by a player with his or her finger of one hand, and a touch sensor formed therein or thereon which can be touched by the player directly with his or her finger of the other hand or indirectly, said housing including a data memory, a control mechanism, and a sound production mechanism, which are connected to each other, said data memory having a plurality of chord data files recorded thereon along with chord IDs for use in identifying chord sounds, the chord data file being for producing chord sounds that have characteristics of sounds on a real musical instrument, through said sound production mechanism, either one of said chord IDs being assigned to each of said plurality of manipulators.

Said control mechanism comprises manipulator selection state detection means that detects which manipulator is being selected by the player and when he or she cancels the selection; specific operation detection means that detects details of the operation including the timing to start touching said touch sensor; and chord production control means adapted to read the chord data file identified by said chord ID that is assigned to the manipulator detected by said manipulator selection state detection means, from said data memory, to supply it to said sound production mechanism, and to let the chord sound that is made producible as a result of it be produced through said sound production mechanism in a manner that is associated with the details of the operation detected by said operation detection means.

In the chord producing device according to the present invention, said specific operation detection means is for detecting, for example, in addition to said the timing to start touching, a direction of the touch operation to one of said touch sensors, a touch operation speed, and a touch operation position. In this case, said chord production control means lets a chord sound determined according to the detected direction or the detected speed be produced through said sound production mechanism when said direction of the touch operation or the touch operation speed is detected, changes an output frequency thereof depending on the change direction when a change in the subject direction of the touch operation is detected, changes an output intensity thereof depending on the speed of change when a change in touch operation speed is detected, and causes production in an output manner that is previously assigned to the detected position when said touch operation position is detected.

Said chord data file is, for example, a data file obtained by means of recording chord sounds on a real musical instrument. The real musical instruments is a stringed musical instrument on which said chord sound is produced when a plurality of strings are strummed almost together. By using such data files, it is possible to produce chord sounds having characteristics very close to those on a real musical instrument.

In a certain aspect, the chord producing device comprises a memory loading-and-unloading mechanism for use in removably connecting said data memory to said control mechanism and the sound production mechanism. This data memory has said data files recorded thereon for each of real musical instruments including said stringed musical instrument-using musical instrument. In addition, the data memory has an image data for use in presenting a musical composition consisted of a series of measures, each measure being associated with one or a plurality of said chord IDs that are assigned for the subject real musical instrument. In the chord producing device that allows access to such a data memory, said control mechanism further comprises display control means adapted to let a musical composition image for one or a plurality of measures be presented on a predetermined image display pane according to the image data for use in presenting said musical composition, and let a next musical composition image including one or a plurality of measures be presented on said image display pane in place of the musical composition image being presented when the chord data file identified on the basis of said chord ID that is associated with the measure(s) of the musical composition image being presented is produced through said sound production mechanism, and said control mechanism conducts change of presentation of the musical composition images on said image display pane in response to the selection of said manipulator and operation of said touch sensor by a player.

This makes it possible to advance the musical composition image under the player's control rather than being device-driven.

The musical composition image presented on said image display pane accompanies, for example, at least one of a lyric of the subject musical composition, information which guides the timing of operating said touch sensor for producing a chord sound, and information which guides the generation of a chord sound on said musical instrument, which are assigned to the subject one or a plurality of measures.

Said control mechanism may further comprise history recording means on which a progress log that keeps track of changing the presentation of said musical composition image, a selection log that keeps track of which said manipulator is selected for the presentation of said musical composition image, and a touch operation log for said touch sensor, are recorded in a mutually associated manner. The chord producing device having such a control mechanism is adapted to supply, in response to the input of an instruction from a player, said progress log out of the information recorded on said history recording means to said display control means, thereby to cause said display control means to reproduce the change in presentation of the musical composition image on said image display pane, and supply said selection log and said touch operation log to said chord production control means, thereby to cause said chord production control means to reproduce the production of a chord sound associated with said change in presentation and change in aspect thereof.

Said data memory has a vibration image data recorded thereon that is for representing a sound vibration image, and said control mechanism may further comprise vibration image display control means adapted to let a vibration image file that is read from said data memory be presented on a vibration image display pane which is different from said image display pane, change the vibration image being presented according to the production of said chord sound, and stop it at the time point when the output intensity reaches zero.

The present invention provides a computer program for use in causing a computer which is mounted in a housing of a portable size to be held with one hand to operate as a portable chord producing device. Said housing has a plurality of manipulators formed thereon each of which can be selected by a player with his or her finger of one hand, and a touch sensor formed therein or thereon which can be touched by the player directly with his or her finger of the other hand or indirectly, said computer being provided with a data memory and a sound product ion mechanism, said data memory having a plurality of chord data files recorded thereon along with chord IDs for use in identifying chord sounds, the chord data file being for producing chord sounds that have characteristics of sounds on a real musical instrument, through said sound production mechanism. In such a thing, the computer program according to the present invention causes said computer to work as: assigning means for assigning either one of said chord IDs to each of said plurality of manipulators; manipulator selection state detection means that detects which manipulator is being selected by the player and when he or she cancels the selection; specific operation detection means that detects details of the operation including the timing to start touching said touch sensor; and chord production control means adapted to read the chord data file identified by said chord ID that is assigned to the manipulator detected by said manipulator selection state detection means, from said data memory, to supply it to said sound production mechanism, and to let the chord sound that is made producible as a result of it be produced through said sound production mechanism in a manner that is associated with the details of the operation detected by said touch operation detection means. Such a computer program is recorded on a computer readable recording medium.

BRIEF DESCRIPTION OF THE DRAWINGS

in FIG. 8, (*a*) to (*c*) are views showing the chords that can be selectively entered by using the operation switch after being assigned (edited);

FIG. 9 is a view illustrating the content of a table for use in managing chord IDs and file IDs;

BEST MODE FOR CARRYING OUT THE INVENTION

Now, an example of an embodiment is described for a case where the present invention is applied to a chord producing device that produces the chord sounds of an acoustic guitar.

<Entire Structure>

Figure 1:
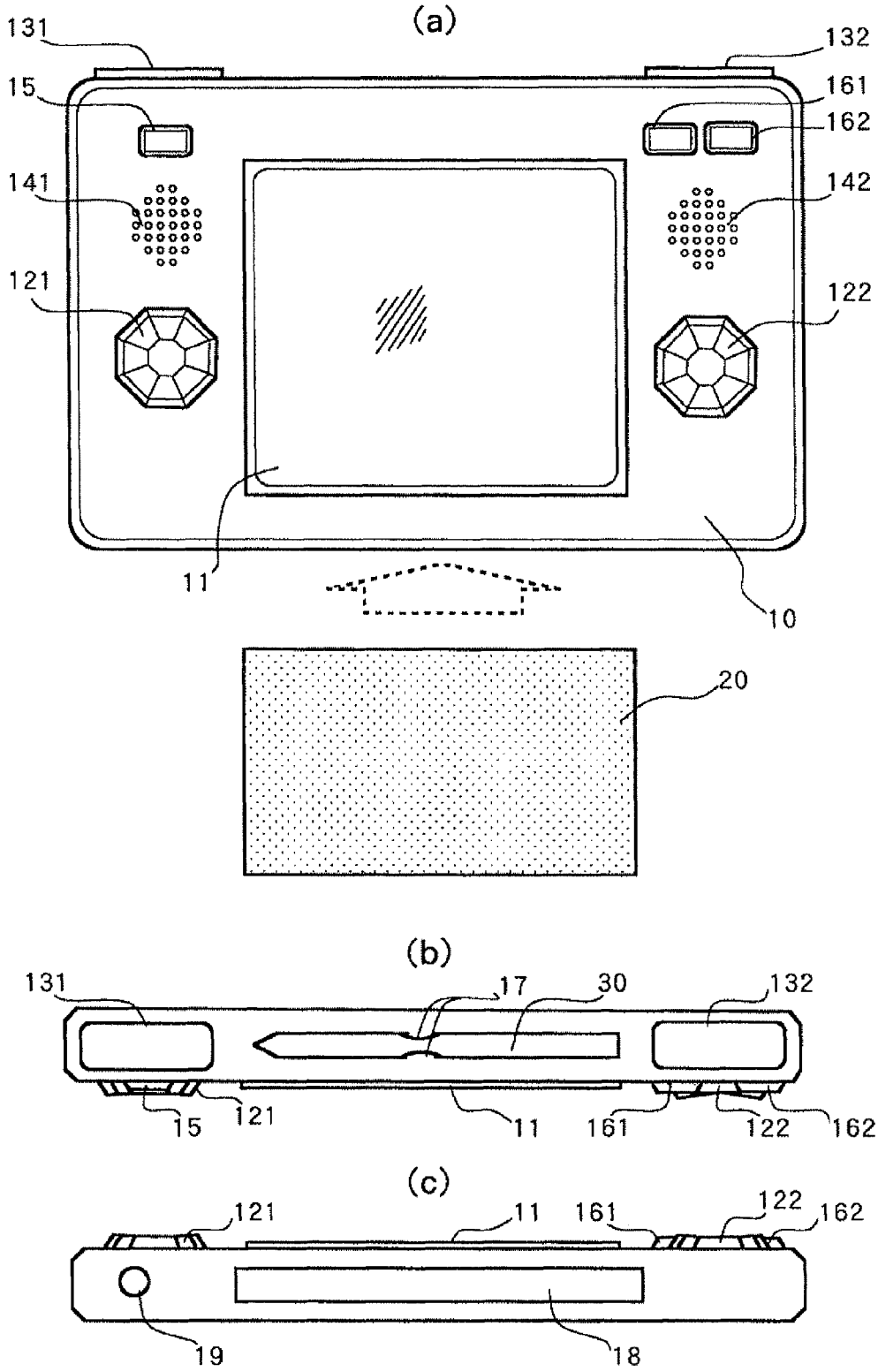
FIG. 1 is a view illustrating a structure showing an example of an embodiment of a chord producing device according to the present invention, in which (a) is a front elevation view, (b) is an upper bottom view, and (c) is a lower bottom view.

FIG. 1 is a view illustrating a structure of a chord producing device according to this embodiment. (a) is a front elevation view, (b) is an upper bottom view, and (c) is a lower bottom view. This chord producing device comprises a housing 10 having a size that allows for grasping with one hand. A memory card 20 can be removably contained within this housing 10.

A display screen 11 which serves as a touch sensor panel is provided at or near the center of the housing 10. The display screen 11 (touch sensor panel) is a display panel made up of, for example, an LCD (Liquid Crystal Display) or an EL (Electronic Luminescence) covered with a touch sensor. The display screen 11 has a slight dent along its outer periphery relative to the surface of the housing 10 in order to allow for a player to trace the outer periphery with a stylus pen which is described below. The touch sensor may be either of resistive, optical (infrared) and capacitive coupled type. The display screen 11 transmits, to a control unit which will be described later, details of the operations including the timing to start touching by the stylus pen and the like, coordinates of the touched position, and change thereof, by means of touching such as pressing or stroking the top surface of the touch panel by using the tip of the stylus pen or a finger (hereinafter, also referred to as a "stylus pen and the like").

The housing 10 has operation switches 121, 122 on the surface thereof and sound passage holes 141, 142 formed in the surface thereof, both at generally symmetrical positions with respect to the perpendicular bisector of a longitudinal side. The operation switch 121 serves as a digital joystick. It has eight manipulators. When a player holds down one of these manipulators, up to eight different data can selectively be entered only during the player's holding down of the manipulator. In other words, which manipulator is being selected by the player and when he or she cancels the selection can be detected by a control unit 40 which is described below. The operation switch 122 serves as a digital switch. It has eight terminal contacts and permits entering up to eight different data by means of holding down one of these eight terminal contacts.

In this embodiment, the operation switch 121 on the left side of the drawing is used as a directional switch across which the player can slide his or her left thumb from the center to one of the eight directions, i.e., 0 degrees, 45 degrees, 90 degrees, 135 degrees, 180 degrees, 225 degrees, 270 degrees, 315 degrees, and press in the switch there. On the other hand, the operation switch 122 on the right side of the drawing is used as a selection switch across which the player can slide his or her right thumb for selecting operation modes, optional functions, and other motions. The functions of these switches 121 and 122 can be reversed for use by both right-handed and left-handed players.

It should be noted that both the operation switches 121, 122 may be configured for use as digital joysticks and a player may be allowed to determine which one of the operation switches is used as the directional switch and which one as the selection switch. In addition, the operation switch 122 does not necessarily have eight terminal contacts. Instead, two to four contacts may be shared.

A power supply switch 15 is provided above the sound passage holes 141. A start switch 161 and a function switch 162 are provided above the sound passage holes 142. These switches 15, 161, 162 may be embodied as, for example, push buttons. The start switch 161 is pressed by the player to start (restart) or stop (pause) the operation. The function switch 162 is pressed to, for example, select menu items such as various preference settings and controls for chords production.

A pair of extended operation switches 131, 132 is provided on the top surface of the housing 10 at generally symmetrical positions with respect to the perpendicular bisector of a longitudinal side. A holder space for a stylus pen 30 and a locking member 17 for the stylus pen 30 are provided at around the center. The extended operation switch 131 is for switching a group of eight directions which can be designated by using the operation switch 121, into a predetermined other group. It is provided at a position where the player can use with his or her left index finger or middle finger when the player holds the housing 10 in his or her left hand. Depending on whether the player holds down the extended operation switch 131 or not, up to sixteen directions can be directed by the control with only the left hand. The same applies to the extended operation switch 132 and the operation switch 122. That is, the extended operation switch 132 can be used to switch a group of up to eight choices to be selected by using the operation switch 122, into another group. This means that the subject chord producing device can produce up to (16×8) different chord timbres.

A slot space 18 for a memory card 20 is formed in the lower surface of the housing 10. An external output terminal 19 is also provided thereon for transmitting chord data produced from the chord producing device to an external amplifier to which a speaker is connected.

<Control Unit, Etc.>

The chord producing device according to this embodiment comprises, within the housing 10, a control unit which is a kind of a computer and peripheral electronic components therefore.

Figure 2:
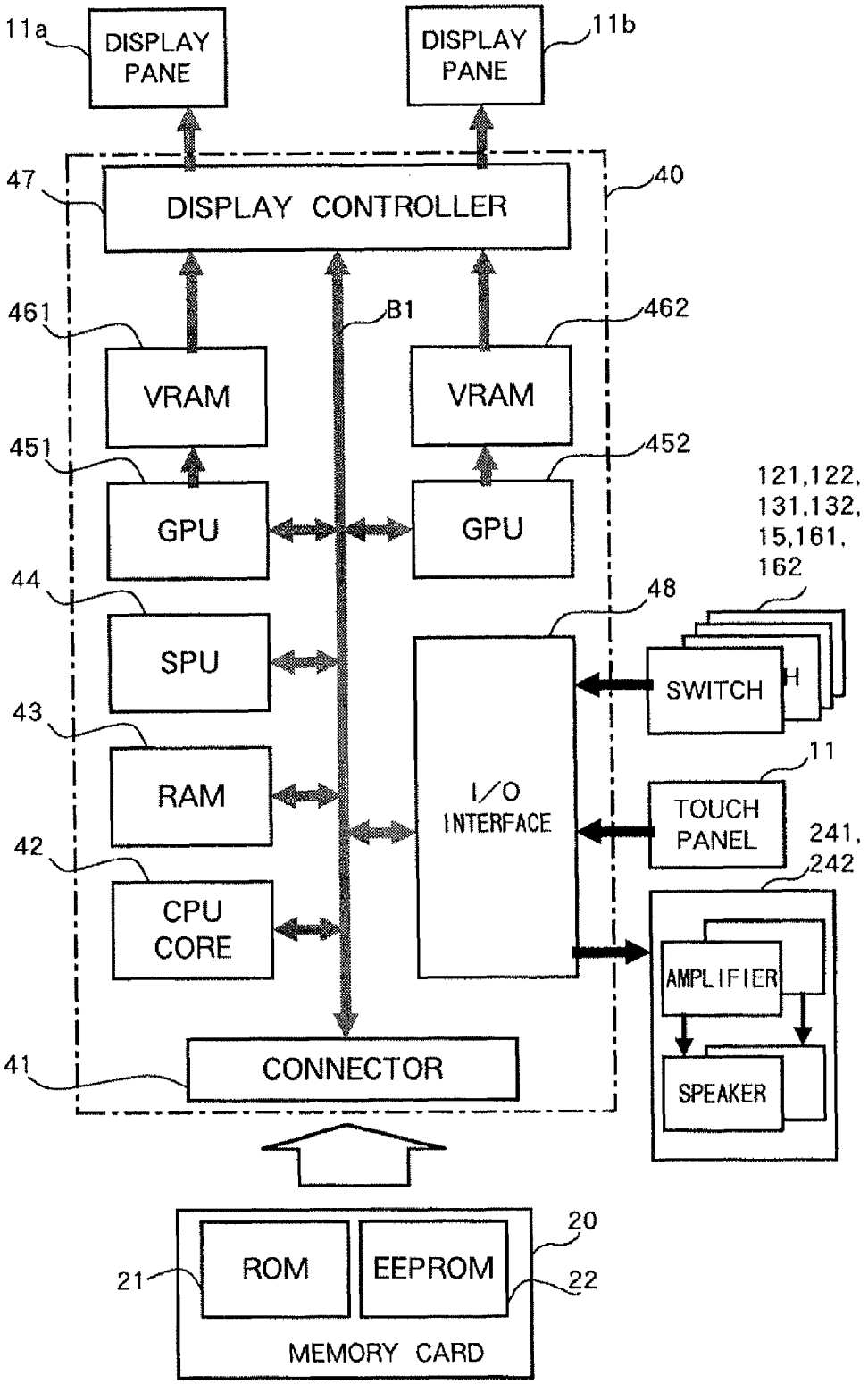
FIG. 2 is an internal configuration diagram of the housing and a connection diagram of various components.

FIG. 2 shows an internal configuration diagram of the housing 10 and connections among various components.

The control unit 40 shown in FIG. 2 has a connector 41 for allowing the memory card 20 to be contained in a removable manner, a CPU (Central Processing Unit) core 42 including a main processor, a RAM (Random Access Memory) 43 which functions as a cache memory, an SPU (Sound Processing Unit) 44 which performs sound processing, two GPUs (Graphic Processor Units) 451, 452 for image processing, a display controller 47 which allows production of images on two image panes 11*a*, 11*b*, and I/O (Input/Output) interface 48, all of which are connected to each other via an internal bus B1.

The SPU 44 and the GPUs 451, 452 may be implemented by, for example, a single chip ASIC. The SPU 44 receives a sound command from the CPU core 42, and performs sound processing according to this sound command. The "sound processing" is, specifically, information processing in order to produce stereo chords that can be reproduced by each of the two sound producing units 241, 242. The GPUs 451, 452 receive a draw command from the CPU core 42 and generates an image data according to the draw command. The CPU core 42 supplies an instruction for image generation which is necessary for the generation of the image data to each of the GPUs 451, 452, in addition to the draw command. The content of the draw command from the CPU core 42 to each of the GPUs 451, 452 varies significantly depending on situations, so this will be described later.

The two GPUs 451, 452 are each connected to VRAMs (Video Random Access Memories) 461, 462 to render the image data. The GPU 451 renders, into the VRAM 461, the image data to be presented on a first display pane 11*a* of the display screen 11. On the other hand, the GPU 452 renders, into the VRAM 462, the image data to be presented on a second display pane 11*b* of the display screen 11. The content of the image data will be described later.

The display controller 47 reads the image data rendered into the VRAMs 461, 462 and performs a predetermined display control process. The display controller 47 includes a register. The register stores data values of "00", "01", "10", and "11" in response to the instruction from the CPU core 42. The data values are determined according to, for example, an instruction from the player selected through the function switch 162. The display controller 47 performs, for example, the following control depending on the data value in the register.

Data Value "00" . . . the image data rendered into the VRAMs 461, 462 is not produced on each of the display panes 11*a*, 11*b*. For example, when the player has got used to operating the chord producing device, and requires no display on the display screen 11, the function switch 162 can be used to let this data value be produced onto the display controller 47.

Data Value "01" . . . only the image data rendered onto the VRAM 462 is produced on the second display pane 11*b*. The second display pane 11*b* is the entire display pane for the display screen 11.

Data Value "10" only the image data rendered onto the VRAM 461 is produced on the first display pane 11*a*. The first display pane 11*a* is the entire display pane for the display screen 11.

Data Value "11" the display pane for the display screen 11 is divided into two pieces, i.e., the first display pane 11*a* and the second display pane 11*b*, and the image data rendered onto the VRAM 461 is produced on the first display pane 11*a* while the image data rendered onto the VRAM 462 is produced on the second display pane 11*b*.

The memory card 20 has a ROM (Read Only Memory) 21 and an EEPROM (Electronically Erasable and Programmable Read Only Memory) 22 mounted thereon. A flash memory or other non-volatile memory may be used in place of the EEPROM. The ROM 21 and the EEPROM 22 are connected to each other via a bus (not shown), and the bus is joined to the internal bus B1 of the control unit 40 through the connector 41. With this, the CPU core 42, the SPU 44, and the CPUs 451, 452 can directly access to the ROM 21 and the EEPROM 22 in the memory card 20.

The I/O interface 48 is supplied with press operation data from the aforementioned various switches 121, 122, 131, 132, 15, 161, and 162 and touch operation data from the display screen 11. The press operation data is a data indicating which one of the buttons the player pressed, while the touch operation data is a data indicating details of the touch operation by the player. When the switches 121, 122, 131, 132, 15, 161, and 162 are activated, the corresponding data is supplied to the CPU core 42 via the I/O interface 48. From the I/O interface 48, chord data is supplied to the sound producing units 241, 242. The chord data is a sound data generated by the CPU core 42 and the SPU 44 which are cooperated with each other. The sound producing units 241, 242 amplify this sound data by using an amplifier and reproduce it through a speaker.

The ROM 21 in the memory card 20 records various image data, chord data files and a program for producing chord timbres. The program for producing chord timbres is for establishing various functions to be used to make the control unit 40 operate as the chord producing device such as, for example, a function to detect the state of manipulator selection by the player, a function to detect details of the operation including the timing to start touching the touch sensor, a function to produce a chord sound associated with a manipulator in a manner that is associated with how the touch sensor has operated, and a history management function, and is carried out by the CPU core 42.

The image data can be generally classified into a vibration image data for presenting sound vibration images, a musical composition image data for presenting musical composition images including lyrics, an initial display image data for presenting initial images, and image data for various settings.

Description is first made about these data.

Figure 3:
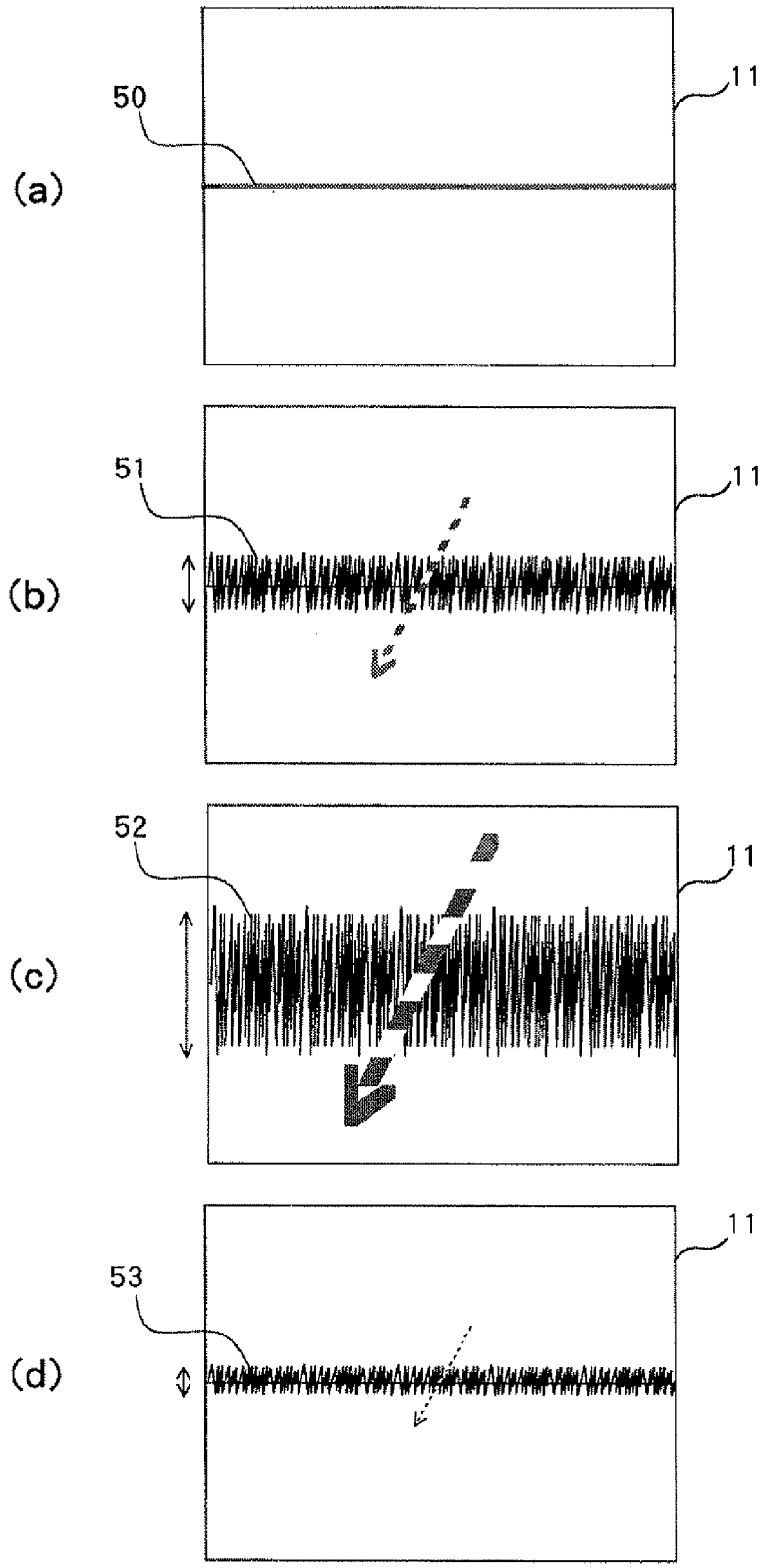
in FIGS. 3, (*a*), (*b*) (*c*), and (*d*) are examples of an initial vibration image, a vibration image for a "moderate" level, a vibration image for a "strong" level, and a vibration image for a "weak" level, respectively.

The vibration image data is a data for presenting vibration images that represent the attack of the notes during the time when the sound data is supplied from the control unit 40 to the sound producing units 241, 242. In this example, based on an initial vibration image, vibration images having three different amplitude values of "weak", "moderate", and "strong" can be presented. FIG. 3 shows presentation examples of these vibration images. FIG. 3 (*a*) is an initial vibration image 50. Vibration image 51 in FIG. 3 (*b*), a vibration image 52 in FIG. 3 (*c*), and a vibration image 53 in FIG. 3 (*d*) represent amplitude values of the "moderate", "strong", and "weak", respectively. Using these amplitude values as the maximum absolute values, the absolute value of the amplitude is actually varied at a frequency suitable for the timing of the sound production.

The initial vibration image 50 and the vibration images 51, 52, 53 are presented on the display screen 11 when an oscillatory waveform mode which is described below is selected. In FIGS. 3 (*b*) to (*d*), the direction of the broken line indicates the direction along which the player touches and slides the stylus pen and the like across the display screen 11. The thickness of the broken line indicates the velocity (touch operation velocity) when the stylus pen and the like is touched. In practice, the broken line is not presented. Which one of the "moderate", "strong", and "weak" is active is determined by means of, for example, receiving detection data about details of the operation including the timing to start touching which is detected by the touch sensor of the display screen 11, coordinates of the touched position, and the speed of its variation, by the CPU core 42 through the I/O interface 48, and comparing these detection data with a predetermined reference data which is recorded on a table not shown.

The representations of the vibration images are not limited to the three patterns of the "moderate", "strong", and "weak". They may be represented in four or more patterns. Alternatively, a single vibration image data may be used to represent a plurality of amplitude values and frequencies by means of image processing.

Figure 4:
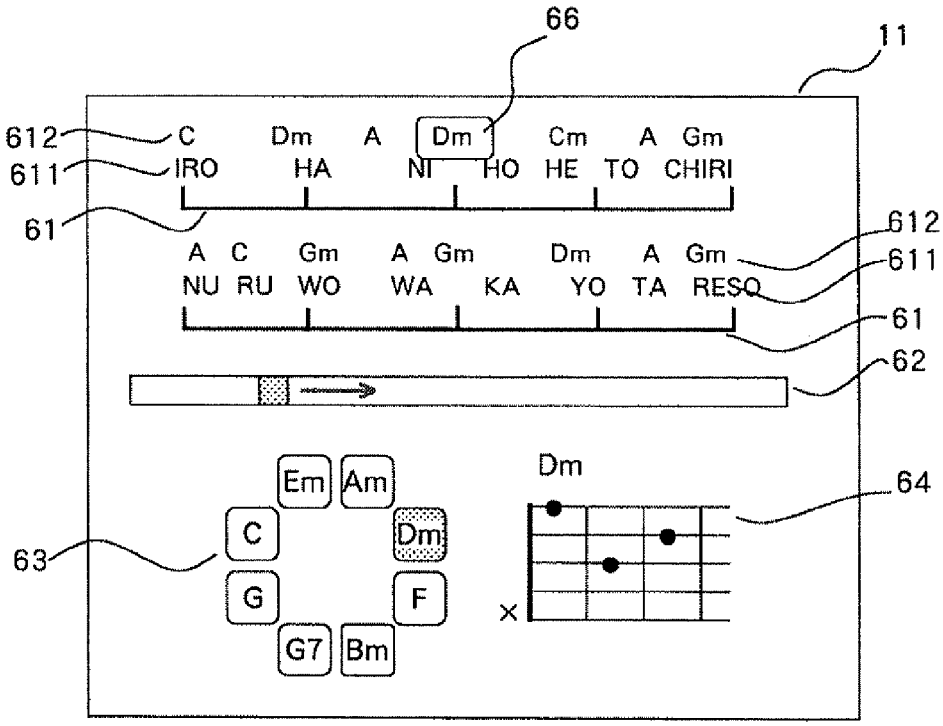
FIG. 4 is a display image showing an example of a musical composition image.

The musical composition image data is provided for every musical composition. Referring to FIG. 4 whish shows an example of a display image on the display screen 11, the musical composition image is made up of, for example, a continuous series of measures 61, music progress bar 62, a manipulator image 63 for a chord guide, and a guide image 64 which indicates fingering positions for each chord on a guitar, a real musical instrument. A lyric 611 and chord symbol indications 612 are provided near their corresponding measure 61. It should be noted that the timing information may also be provided for each measure in order to show the timing of operating manipulators, or the lyric 611 may be omitted. The minimum required is the chord symbol indications 612. Each measure is identified by using measure IDs, and each measure ID is associated with the data corresponding to the chord symbol indications 612, the manipulator image 63, and the guide image 64 as well as lyrics data. In addition, each chord symbol indication 612 is associated with a chord ID for use in identifying the subject chord.

The musical composition image is selectively rendered onto the VRAM 462 by means of, for example, the GPU 452, and is presented on the second display pane 11*b* through the display controller 47.

Figure 5:
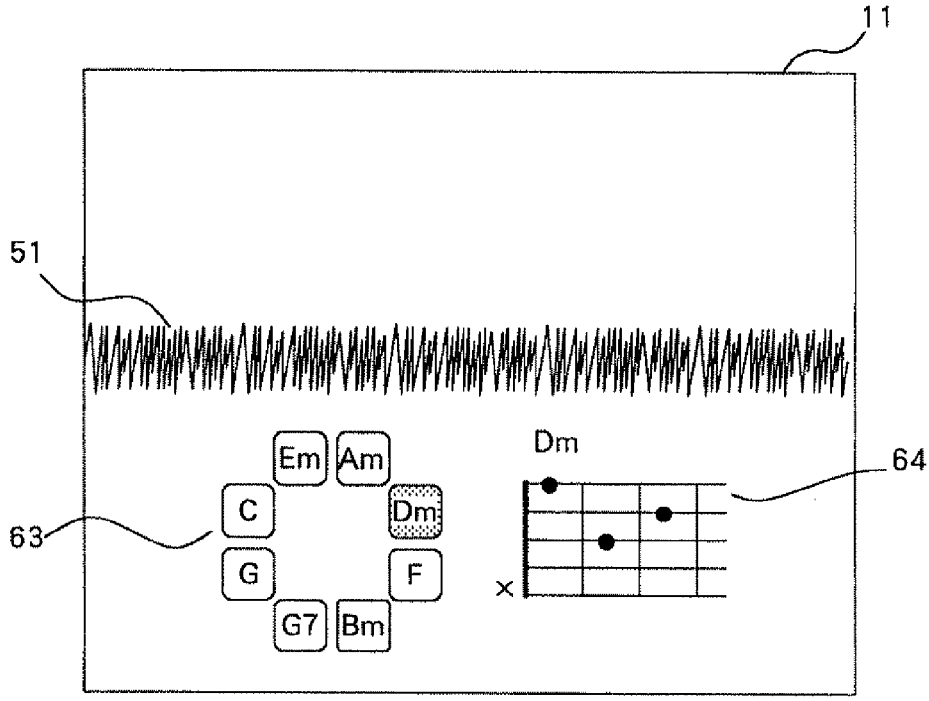
FIG. 5 is a display image showing an example of a guidance image.

Only a part of the musical composition image data can be read and presented. For example, FIG. 5 is an example of a display image during a guidance mode which will be described later. Shown is an example where only the manipulator image 63 and the guide image 64 are read and presented along with the vibration image 51 shown in FIG. 3 (*b*).

The initial display image data is an image to be presented on the display screen 11 when the power supply is turned on.

The image data for settings is a data for presenting the images of the various switches 121, 122, 131, 132, 15, 161, and 162 as well as a screen on which functions assigned thereto are displayed. These image data are rendered onto the VRAM 462 by, for example, the GPU 452 when "set" is selected with the function switch 162, and are presented on the second display pane 11*b* through the display controller 47. During the "set" period, the display screen 11 provides what is presented on the second display pane 11*b*.

Figures 6, 7:
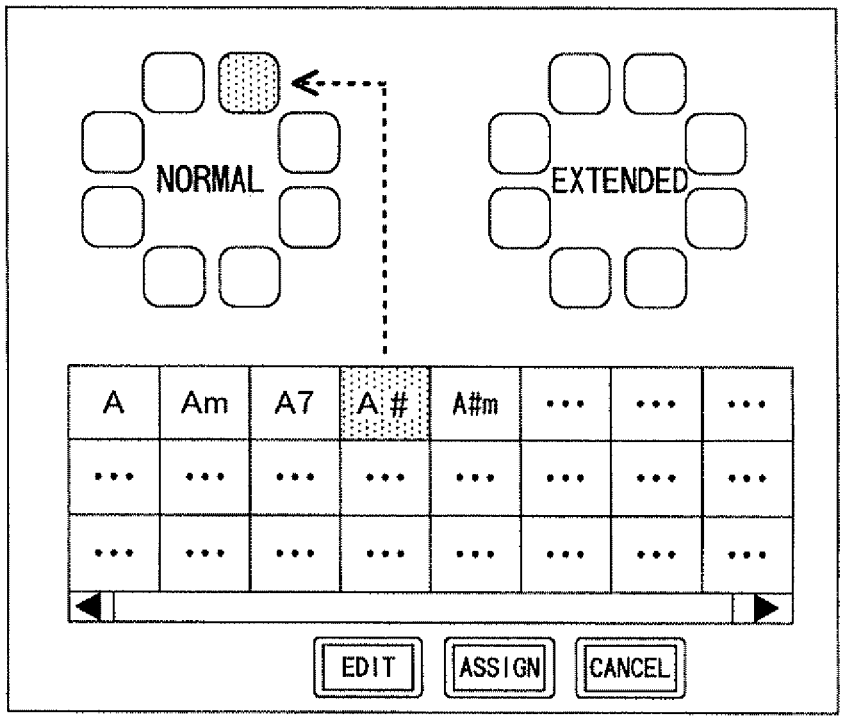
FIG. 6 is an example of a screen through which a player can assign chords to the eight manipulators of an operation switch and an extended switch (or overwrite the existing chord(s))
FIG. 7 is an example of a screen through which a player can check the current settings.

For example, FIG. 6 is an example of a screen through which a player can as sign chords to the eight manipulators of the extended switch 131 (or overwrite the existing chord(s)). FIG. 7 is an example of a screen through which a player can check the current settings. The image data for settings can be presented by, for example, hitting the function switch 162 at a predetermined number of times.

The upper left part of FIG. 6 shows an image of an arrangement of the manipulators to which up to eight different chords can be assigned that can be selected by using the operation switch 121 without holding down the extended switch 131. The upper right part shows an image of an arrangement of the manipulators to which up to eight different chords can be assigned that can be selected by using the operation switch 121 while holding down the extended switch 131. The table in the lower part represents an image to show the chords which can be assigned to each manipulator. The player selects a manipulator on the upper left or right in FIG. 6 by using the selection switch 122, presses the "assign" button, determines, by using the selection switch 122, the chord to be selectively entered with the manipulator in question, and again presses the "assign" on the lower part of FIG. 6. This is repeated. As a result, the settings are recorded on the EEPROM 22 in the memory card 20, are read upon the startup of the device, and chord IDs are assigned to the manipulators of the operation switch 121. The order of assigning the settings may be discretionary, and the order of the selection of the manipulator and the selection of the chord may be reversed from those described above.

Referring to FIG. 7, each of "music tune #1" to "music tune #4", and "user setting 1" to "user setting 4" is assigned to the eight manipulators of the selection switch 122 at default. The sixteen different chords shown in FIG. 6 are assigned to each of the "music tune #1" to "music tune #4". If the player wants to modify it, he or she can press the "edit" on the lower part of the screen shown in FIG. 6 and overwrite it according to the aforementioned procedure. Each of the "user setting 1" to "user setting 4" is for setting player's preferences through the display image as shown in FIG. G.

FIGS. 8 (*a*) to (*c*) show the chords that can be selectively entered by using the operation switch 121 after being assigned (edited) as described above.

The EEPROM 22 records the settings of the aforementioned chord ID for the manipulators, the settings for the operation modes after the initial screen has presented, and various pieces of history information. The operation modes in this embodiment are the following three: an oscillatory waveform mode, a guidance mode, and a karaoke mode. The oscillatory waveform mode is a mode during which the vibration images 50 to 53 in FIGS. 3(*a*) to (*d*) are presented on the entire display screen 11. The guidance mode is the guidance mode is a mode during which the image as shown in FIG. 5 is presented on the entire display screen 11. The karaoke mode is a mode during which the image as shown in FIG. 4 is presented on the entire display screen 11. Details of these operation modes will be described later.

The history information is made up of a data representing a progress log that keeps track of the presentation of the musical composition image, a selection log that keeps track of which manipulator is selected for the presentation of the musical composition image, and a touch operation log, a time instant data generated by each data, and a serial number data which is kept until it is erased. The time instant data is measured by using a timer which is not shown. The serial number data is numbered when the data representing the history is recorded.

The chord data file recorded on the ROM 21 is not the one that is electronically created. Instead, it is a data file obtained when a so-called virtuoso player records the chord sounds actually produced on a guitar which is a real musical instrument. Each chord timbre is picked up in the direction from top to bottom of a guitar sound hole (the aforementioned first direction), from bottom to top (the aforementioned second direction), the "weak" (first level), the "moderate" (second level), and the "strong" (third level), and each is compiled as a single data file which is identified by the aforementioned chord ID and a lower file ID. Therefore, six files are prepared for a single chord (e.g., Am).

A major reason why a plurality of data files are prepared for every single chord timbre is to prevent the tones of the real chord sounds from being changed as much as possible by means of reducing post-waveform processing as much as possible. Another reason lies to cause a secondary effect of increasing information processing by the CPU cure 42 and the SPU 44 or making it possible to achieve the function of producing chord sounds without requiring much processing capacity, by reducing the waveform processing.

The chord ID and the file ID are managed in a hierarchical manner by using a table which is not shown. FIG. 9 is a view illustrating the content of this table. The entry "c10100" is a chord ID for identifying the "Am". File IDs "c101001" to "c101006" follows at a lower level. The "c101001" is a file ID for identifying the chord data file for the chord Am in the first direction (from top to bottom) at the level 1 (weak). The "c101006" is a file ID for identifying the chord data file for the chord Am in the second direction (from bottom to top) at the level 13 (strong). For the other chord IDs and file IDs, the IDs are assigned according to a similar rule.

<Operation of the Chord Producing Device>

Next, an operation of the chord producing device that is configured as described above is described.

For example, the chord producing device becomes operable when a player holds the housing 10 with his or her left hand, operates (presses/releases) the operation switch 121 and the like with his or her left hand finger, holds the stylus pen 30 with his or her right hand or merely with his or her finger(s), and touches the display screen 11 with the tip of the pen or the tip of his or her finger.

When the player turns on the power supply switch 15 with the memory card 20 mounted into the housing 10, the control unit 40 (the CPU core 42) accesses the ROM 21 in the memory card 20 and starts execution of the program for producing chords. In addition, the control unit 40 loads the data recorded on the ROM 21 and the EEPROM 22 in the memory card 20 as well as apart or all of the table onto the RAM 43. This completes the establishment of the operational environment for a player to play this device as a musical instrument.

Immediately after the power supply is turned on, the control unit 40 presents the initial screen on the entire display screen 11. The initial screen includes the options for the operation modes selected by the player. When the player selects one of the aforementioned oscillatory wave form mode, the guidance mode, and the karaoke mode through the function key 162, and presses the start button 161, the control unit 40 switches the initial screen into an operation screen for the selected operation mode to perform a process under each operation mode. Now, referring to FIGS. 10 to 15, operation procedures for the respective operation modes are described.

Figure 10:
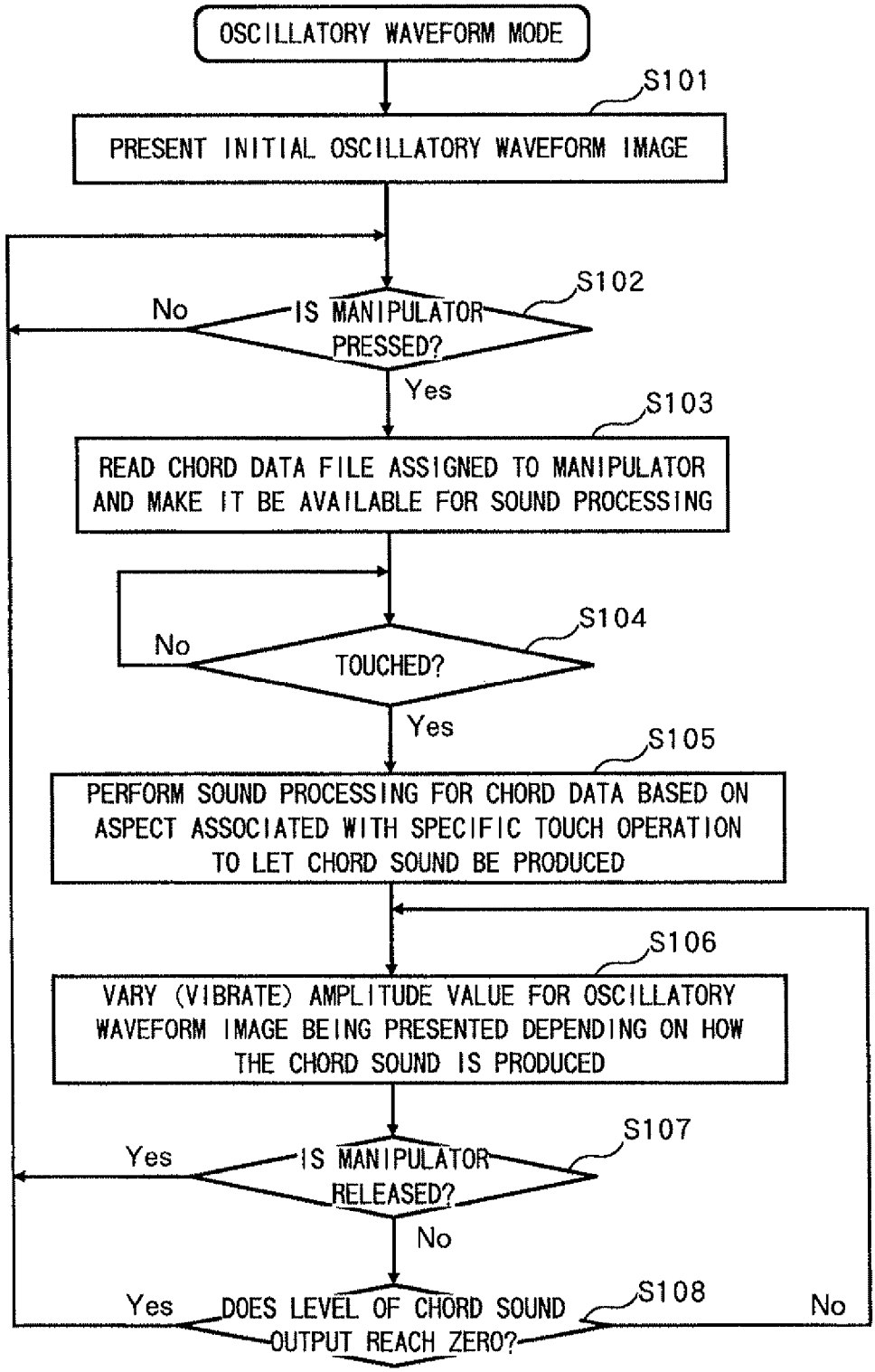
FIG. 10 is a procedure chart for an oscillatory waveform mode.

FIG. 10 is a procedure chart for the oscillatory waveform mode.

When the oscillatory waveform mode is selected, the control unit 40 presents an initial oscillatory waveform image on the entire display screen 11 (S101). This process is achieved by means of sending a draw command and an image data from the CPU core 42 to the GPU 451, and sending the aforementioned data value "10" to the display controller 47.

Upon sending that either one of the manipulators of the operation switch 121 (or along with the extended switch 131) is pressed by the player (S102: Yes), the control unit 40 reads the chord data file identified by the chord ID that is assigned to the subject manipulator from the RAM 43 or the ROM 21 and makes it be available for the sound processing by the SPU 44 (S103). At this time, no chord sound is produced.

In this example, only during the time when the manipulator is pressed, the control unit 40 reads the chord data file identified by the chord ID that is assigned to that manipulator from the RAM 43 or the ROM 21 and makes it be available for the sound processing by the SPU 44 (S103). As a result, a chord sound is produced only during the time when the manipulator is pressed, and the production of the chord sound is stopped when the manipulator is released, so that the user can easily control the time interval during which the chord sound is produced. Various forms may be achieved such as other forms in which the SPU 44 is allowed to perform the sound processing until a predetermined period of time has passed after the manipulator is released (in this case, the sound may be muted and fade out after the manipulator is released).

Upon sensing the specific touch operation according to the output data supplied from the touch sensor (S104: Yes), the control unit 40 performs the sound processing for the chord data in a manner that is associated with the specific touch operation, to let the chord sound be produced (S105) If no specific touch operation is sensed (S104: No), the step S104 is repeated until the specific touch operation is sensed.

As an example of the "aspect associated with the specific touch operation", an example is given in which the tone and attack (s) of output chord notes are varied depending on the direction of the touch operation, the touch operation speed, and their changes. That is, even when the identical chord is specified, the frequency is slightly higher when touched in the downward direct ion (first direction), and it is lower when touched in the upward direction (second direction). This is because a similar result will be obtained on the strings of a guitar which is a real musical instrument. In addition, a higher touch operation speed rather than a lower one will provide a higher output intensity (level 3>level 1). At a touch operation speed of the degree of a light touch, faint sound (level 1) is produced.

In which direction the touch operation is made, is determined by means of detecting the direction in which the touch operation continues, triggered by the detection of the position where the touch operation is started. The touch operation speed is determined by means of detecting the amount of continuous touch operation per a unit period of time. The change in directions of operation is determined by, for example, pattern matching of the change in positions of the touch operation. In order to facilitate these detections, it is preferable that the position where the touch operation is started be temporarily stored on the RAM 43. In addition, a basic pattern is prepared that serves as an indicator for the pattern matching.

The step S105 is achieved by means of selecting one of the chord data files illustrated in FIG. 9 according to the file ID, and sending it to the SPU 44. When a chord sound is produced from the SPU 44 in the aforementioned manner, the amplitude value for the oscillatory waveform image being presented on the display screen 11 is varied (vibrated) depending on how the chord sound is produced such as the attack of the notes (level 1 to level 3) (S106).

When it is sensed that the pressed manipulator is released, that is, when operation is stopped or another manipulator is designated, the process goes back to the process at the step S102 (S107: Yes). If the manipulator is not released (S107: No), the process at and after the step S106 is repeated (S108: No) until the level of the chord sound output reaches zero. This keeps providing sustained sound for a predetermined period of time. When the sustained sound disappears and the level of the chord sound output reaches zero, the process goes back to the step S102 (S108: Yes).

As apparent from the above, in the oscillatory waveform mode, the player can operate the chord producing device while enjoying the sustained sound of the chords, looking at the oscillatory waveforms. In addition, the chord sounds are produced only through free and easy operations at a player's pace, so that it becomes easier to sing a song while at the same time playing the device unlike conventional electronic musical instrument devices. The player can accompany many fellows singing in chorus under the player's control.

Next, described is a process to be performed when a certain chord sound (first chord sound) is produced first and then another chord sound (second chord sound) is produced by means of the touch operation performed again. For the production of the first chord sound and the production of the second chord sound, various processes can be done. For example, possible processes include: "as to the first chord sound, the first chord sound is muted (weakened until it disappears) and only the second chord sound is produced", "the first chord sound output is continued as in the case where no second chord sound is produced and it is combined with the second chord sound", "the first chord sound is made fade out and is combined with the second chord sound output".

In addition, as to the second chord sound, various processes can be expected such as "it is produced first as in the case where no first chord sound is produced", "the volume at the beginning of the output is set to low and is gradually made stronger (fade in) to combine with the first chord sound". The process for the production of the first chord sound can be appropriately combined and performed with the process for the production of the second chord sound.

Now, referring to FIGS. 11A and B, an example is given for a process for each of the first and second chord sounds in which the first chord sound is produced and subsequently the second chord sound is produced.

Figure 11A:
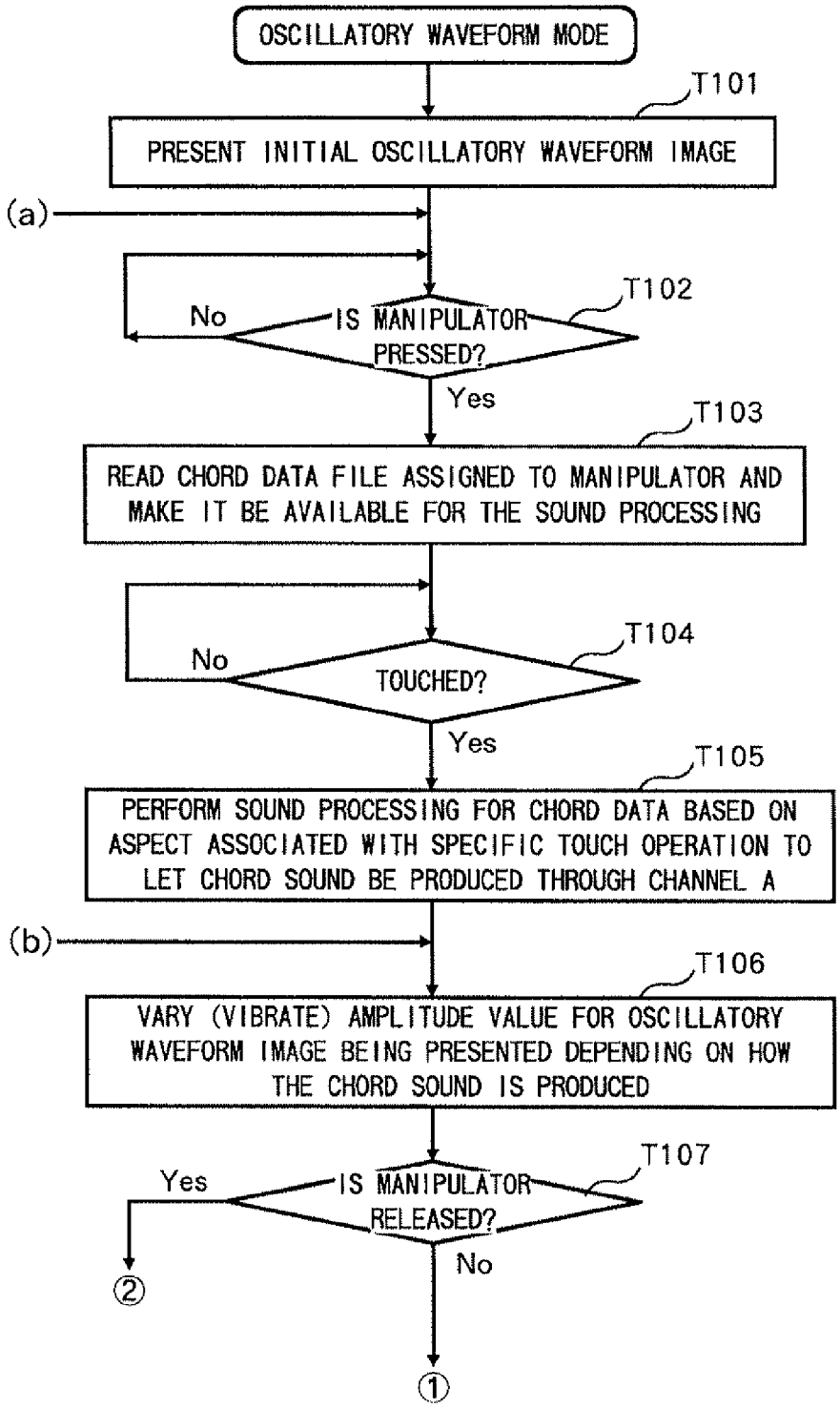
FIG. 11A is a procedure chart showing an example of a process for each of first and second chord sounds when the first chord sound is produced and subsequently the second chord sound is produced.
Figure 11B:
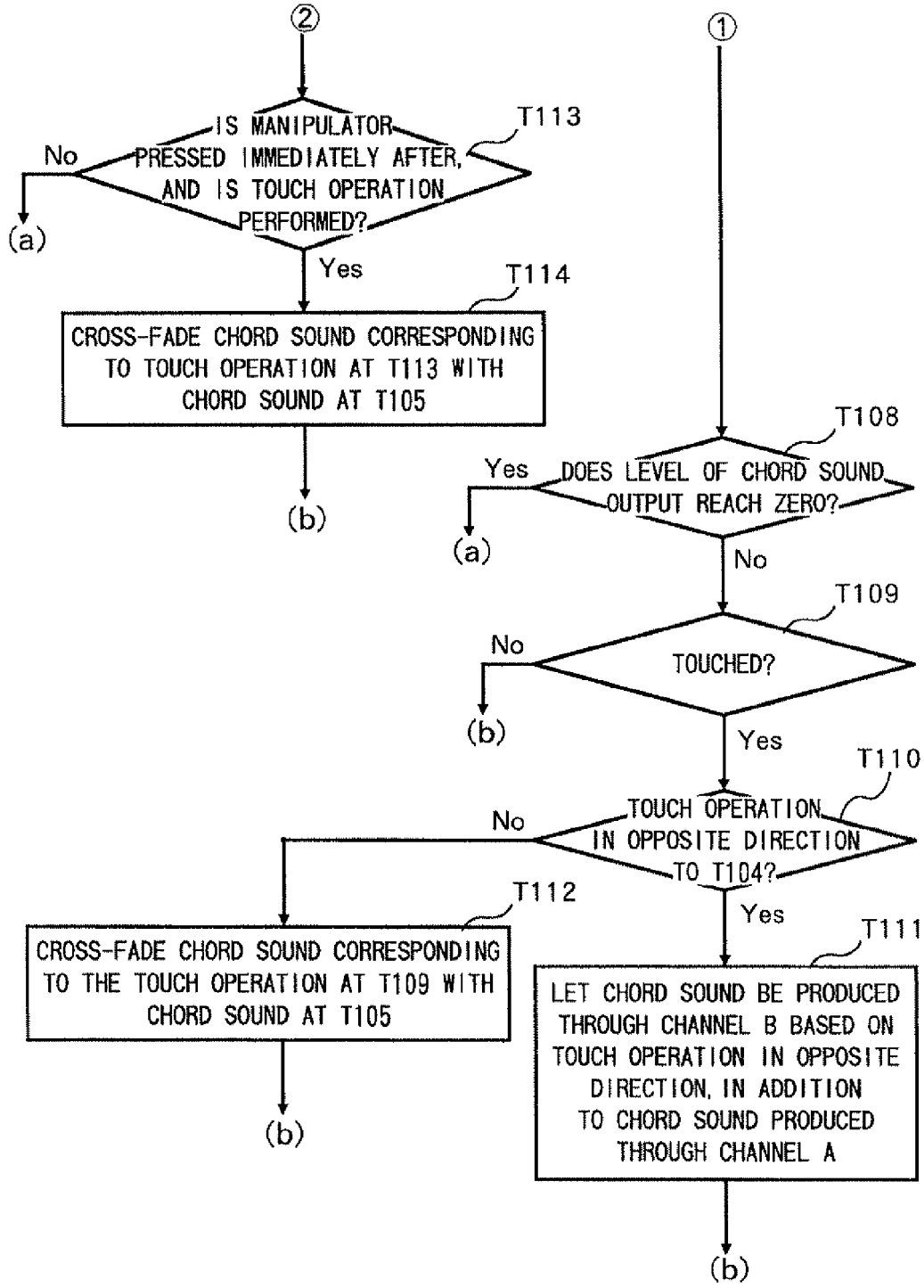
FIG. 11B is a procedure chart showing an example of a process for each of first and second chord sounds when the first chord sound is produced and subsequently the second chord sound is produced.

In FIGS. 11A and B, when the oscillatory waveform mode is selected, the control unit 40 presents an initial oscillatory waveform image on the entire display screen 11 (T101). This process is achieved by means of sending a draw command and an image data from the CPU core 42 to the GPU 451, and sending the aforementioned data value "10" to the display controller 47.

Upon sending that either one of the manipulators of the operation switch 121 (or along with the extended switch 131) is pressed by the player (T102: Yes), the control unit 40, reads a first chord data file identified by the chord ID that is assigned to the subject manipulator from the RAM 43 or the ROM 21 and makes it be available for the sound processing by the SPU 44 (T103), only during the time when the manipulator is pressed, and during the time when it is required to produce a chord sound or sounds after the release of the manipulator in the case when two chord sounds are combined which will be described later. At this time, no first chord sound is produced. Upon sensing the specific touch operation according to the output data supplied from the touch sensor (T104: Yes), the control unit 40 performs the sound processing for the first chord data in a manner that is associated with the specific touch operation, to let the first chord sound be produced (T105).

At that time, in the embodiment shown in FIGS. 11A and B, there are two channels, channels A and B, through which the chord sounds are produced. Either an identical chord sound or different chord sounds may be produced through these channels. At T105, the chord sound is produced through the channel A. It should be noted that, although two channels A and B are used in this example, the chord sounds may be produced through three or more channels such as channels A, B, and C In addition, the control unit 40 reads the chord data file identified by the chord ID that is assigned to the manipulator from the RAM 43 or the ROM 21 and makes it be available for the sound processing by the SPU 44 for each one of the channels. When the specific touch operation is detected, the control unit performs sound processing for the chord data based on an aspect which is associated with the specific touch operation to let the chord sound be produced.

In this example, description is made under the assumption that the first chord sound corresponds to the C chord and the touch operation is performed in the downward direction (first direction).

If no specific touch operation is sensed (T104: No), the step T104 is repeated until the specific touch operation is sensed, As to the "aspect associated with the specific touch operation", as in the case shown in FIG. 10, it is possible to use different frequencies or different sound levels for the cases where the touch operation is performed in the downward direction (first direction) and in the upward direction (second direction).

The step T105 is achieved by means of selecting one of the chord data files illustrated in FIG. 9 according to the file ID, and sending it to the SPU 44. When a chord sound is produced from the SPU 44 in the aforementioned manner, the amplitude value for the oscillatory waveform image being presented on the display screen 11 is varied (vibrated) depending on how the chord sound is produced such as the attack of the notes (level 1 to level 3) (T106).

Next, it is determined whether the manipulator that has kept pressed is released or not. If the manipulator is not released (T107: No), it is detected whether or not the chord output level is equal to zero. If it is equal to zero (T108: Yes), the process goes back to T102. If it is not equal to zero (T108: No), it is determined whether the touch operation is performed or not. If the touch operation is not performed (T109: No), the process goes back to T107.

If the touch operation is detected at T109 (T109: Yes), it is detected whether or not that touch operation is performed in the direction opposite to the direction of the touch operation performed at T104. If the touch operation is performed in the opposite direction (T110: Yes), the chord sound (second chord sound) corresponding to the touch operation in the opposite direction at T108 is produced through the channel B in addition to the first chord sound (in this example, the chord sound of the chord C that is produced through the touch operation in the first direction) produced through the channel A. In this example, the touch operation is performed in the first direction for the C chord at T104, so that the touch operation performed in the second direction for the same C chord is detected, and the chord data associated with this can be read as the second chord sound, out of the chord data files that are recorded on the ROM 21. The control unit 40 performs the sound processing for this chord data, and let the second chord sound be produced (T111) and then the process goes to T106.

Figure 12:
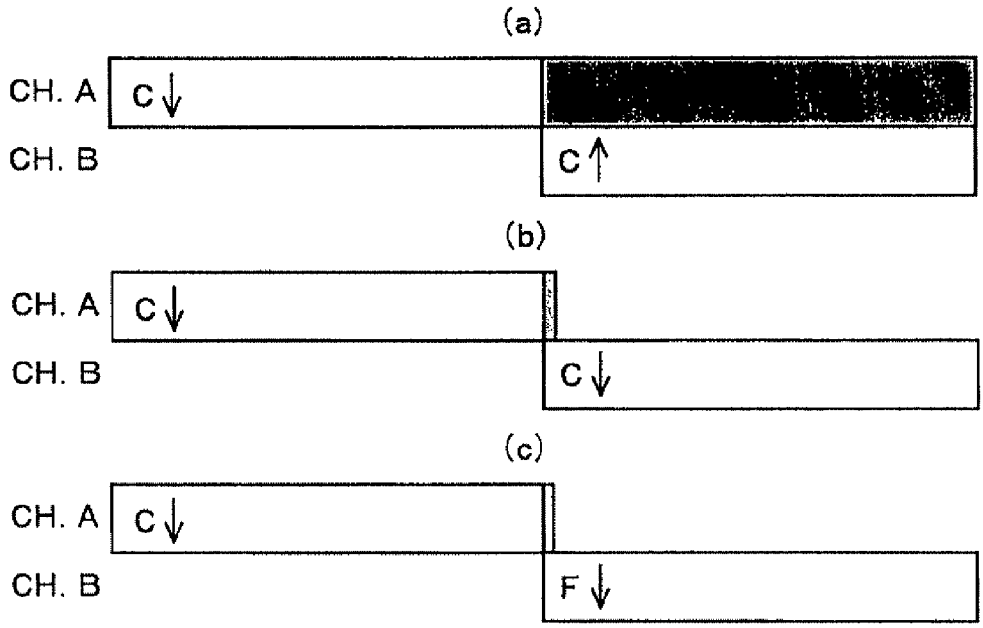
in FIG. 12, (*a*) to (*c*) are explanatory diagrams for chord sounds that are produced through each of channels A and B.

FIG. 12 (*a*) shows an explanatory diagram for chord sounds that are produced through each of the channel A (in the figure, Ch. A) and the channel B (in the figure, Ch. B) in this case. As shown in this figure, the second chord sound is produced through the channel B, in addition to the first chord sound output through the channel A. The production of the second chord sound through the channel B does not affects the chord sound produced through the channel A. For the chord sound produced through the channel A, sustained sound is produced for the aforementioned predetermined period of time as in the case where no output is made through the channel B. Accordingly, in this case, the first chord sound produced through the channel A and the second chord sound produced through the channel B are mixed and come out through a speaker.

In a situation where a real musical instrument such as a guitar is played, when a player strums a certain chord with a stroke in a predetermined direction and then strums again the same chord with a stroke in the opposite direction, the sound of the previous chord strummed with a stroke in the predetermined direction sounds like overlapping with the sound of the chord strummed with a stroke in the opposite direction even after the chord is strummed with a stroke in the opposite direction, due to the effects of, for example, the resonance of the body of the musical instrument and sound reverberation.

On the contrary, when an electronic chord sound is produced through a speaker, no resonance effect of the body of the musical instrument as described above can be obtained. Therefore, if the second chord sound is merely produced after the first chord sound is produced, a user would find that "it has a different sound from the one obtained on a real musical instrument" and feel it is acoustically unnatural.

In this example, the first chord sound and the second chord sound are mixed and produced as described above, so that the first chord sound is overlapped and produced with the second chord sound as in a case of the real musical instrument. This reduces the possibility of giving the user an acoustically unnatural feeling.

Next, if the touch operation detected at T109 is not the touch operation performed in the direction opposite to the direction of the touch operation performed at T104, (T110: No), that is, when it is the touch operation performed in the same direction as in the touch operation at T104 for the identical chord, the corresponding chord, i.e., the C chord touched in the first direction in this example, is produced as the second chord sound through the channel B (T112), and the process goes to the step T106. Accordingly, the first chord sound produced through the channel A is the same chord sound as the second chord sound produced through the channel B.

Figure 13:
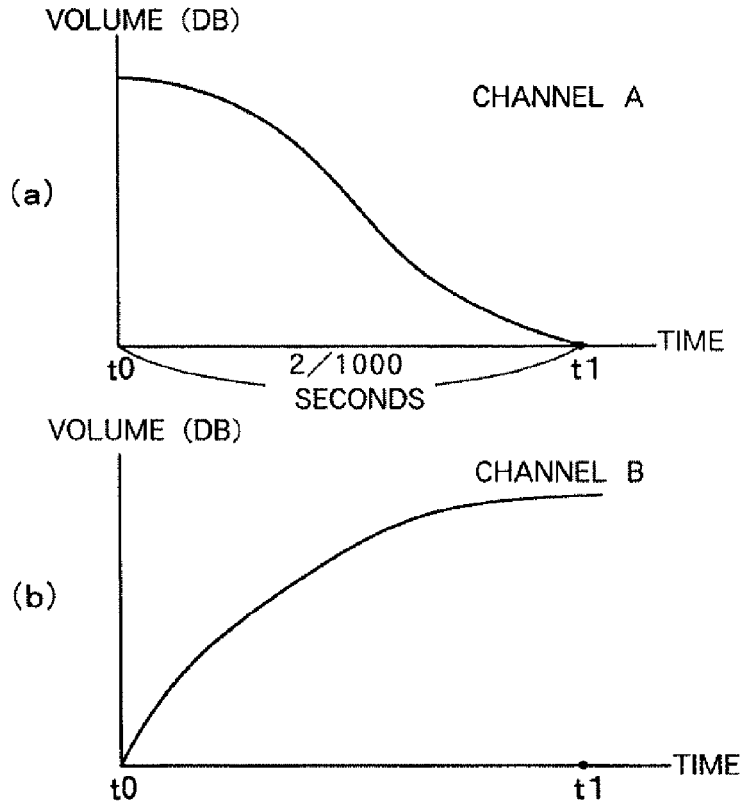
in FIG. 13, (*a*) is an explanatory diagram showing an output transition of a chord sound produced through a channel A, (b) is an explanatory diagram showing an output transition of a chord sound produced through a channel B.

In this example, as shown in FIG. 13 (*a*), for the chord sound produced through the channel A, the time point when the touch operation in the direction same as the direction in the touch operation at T104 is detected is assumed to be $t_0$. The sound is caused to gradually become weaker from $t_0$ and the volume is caused to reach zero at the time $t_1$. On the other hand, as shown in FIG. 13 (*b*), the chord sound produced through the channel B has the lowest volume at $t_0$, gradually becomes higher in volume, and reaches a predetermined volume at the time point $t_1$. The time duration from $t_0$ to $t_1$ can be determined arbitrarily. In this example, it is equal to two thousandths of a second (0.002 seconds) so that it sounds natural to the user's ear. However, this time duration may appropriately be determined to be longer or shorter than 0.002 seconds. In addition, this time duration may be varied dynamically depending on, for example, the sound pitch, the force in the touch operation, and the interval between a given touch operation and the subsequent touch operation. This control can be performed by the SPU 44.

The technique that gradually fades out the sound on the channel A while fading in the sound on the channel B during a short period of time (in this example, about 0.002 seconds) is referred to as "cross-fade". Without using the cross-fade, a possible time lag between the time point when the output of the first chord sound is terminated and the time point when the second chord sound is produced can result in a time duration during which no sound is generated. Even if such a time lag can be eliminated, it sounds acoustically unnatural if there is no time duration during which the first and the second chord sounds are produced simultaneously. The cross-fade causes it to sound acoustically naturally.

In the cross-fade, the sum of the volumes on the channels A and B may be controlled to always have a value that is the same as a volume value from the channel A at $t_0$. In this example, in order to clearly notify the user that the touch operation has performed at T109 and the corresponding chord sound is produced, the sound produced through the channel B is controlled to have a higher volume so that the sum of the volumes on the channels A and B becomes larger than the volume value on the channel A at $t_0$. The sum of the volumes on the channels A and B is not limited specifically. It can be determined according to various procedures.

Next, at T107, when the release of the manipulator is sensed, that is, when the operation is stopped or another manipulator is designated, it is determined whether or not another manipulator is pressed immediately after it and the touch operation is performed. It requires a certain amount of time for a user to release and press again the manipulator, and if operation is made within this time period, then it is considered that "the manipulator is pressed immediately after it". If another manipulator is pressed immediately after, and when the touch operation is performed (T113: Yes), the chord sound (second chord sound) associated with this manipulator and the direction of the touch operation are read from the chord data file recorded on the ROM 21, the first chord sound and the second chord sound are cross-faded as described above (T114), and the process goes back to the step T106. At T113, if another manipulator is pressed immediately after it, and when it is not determined that the touch operation is performed (T113: No), the process goes back to T102.

As apparent from the above, natural chord sounds are produced which is closer to those on a real musical instrument by means of distinguishing the situation where the second chord sound has the same chord as the first chord sound but the direction of the touch operation (the direction of strumming with a stroke on a real musical instrument such as a guitar) is reversed and any other situations, to change the way for the chord output processing.

In particular, in this embodiment, when the first chord sound is produced and subsequently the second chord sound is produced which is identical to the first one for the same chord notes in the same direction of the touch operation except for the attack of the notes, these two chord sounds are mixed. Otherwise, the first chord sound and the second chord sound are cross-faded faded before production. This achieves more natural chord sound production.

In conventional chord producing devices, the necessity for the aforementioned distinguishment is not recognized, and the sounds are produced regardless of the types of the first chord sound and the subsequent second chord sound. Accordingly, a user would possibly feel that the produced chord sounds are acoustically unnatural. However, in this embodiment, such unnaturalness is overcome.

It should be noted that, in this embodiment, ongoing echo effect processing can be performed that varies the tone quality of ongoing echoes of the chords by means of changing the direction of operation of the stylus pen and the like.

Figure 14:
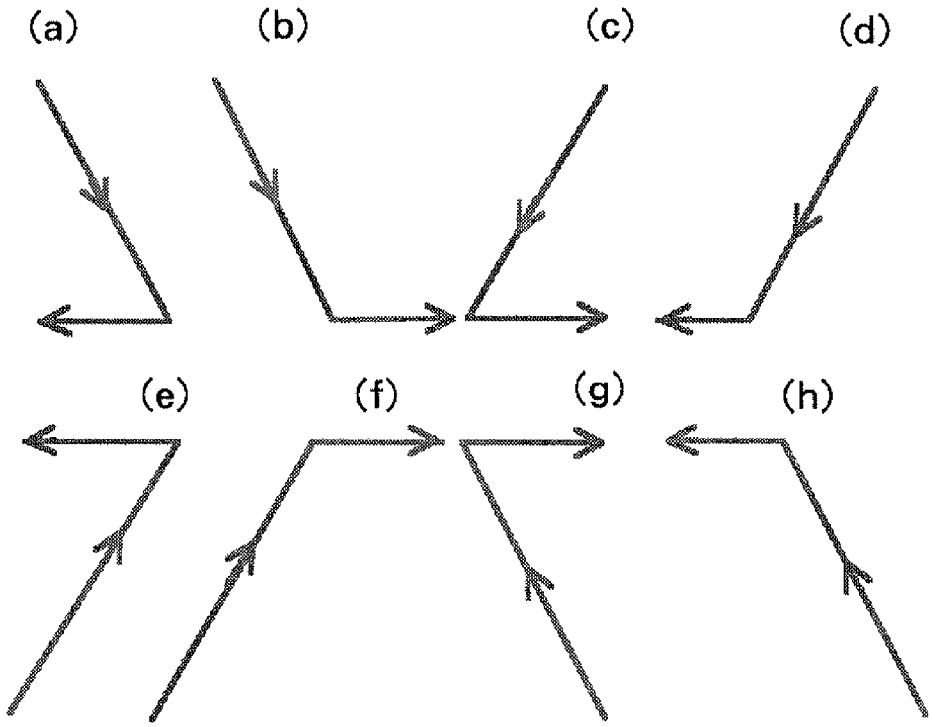
in FIG. 14, (*a*) to (*d*) show examples where a stylus pen and the like is moved in the downward direction and then moved in the lateral direction, (e) to (h) show examples where it is moved in the upward direction and then moved in the lateral direction.
Figure 15:
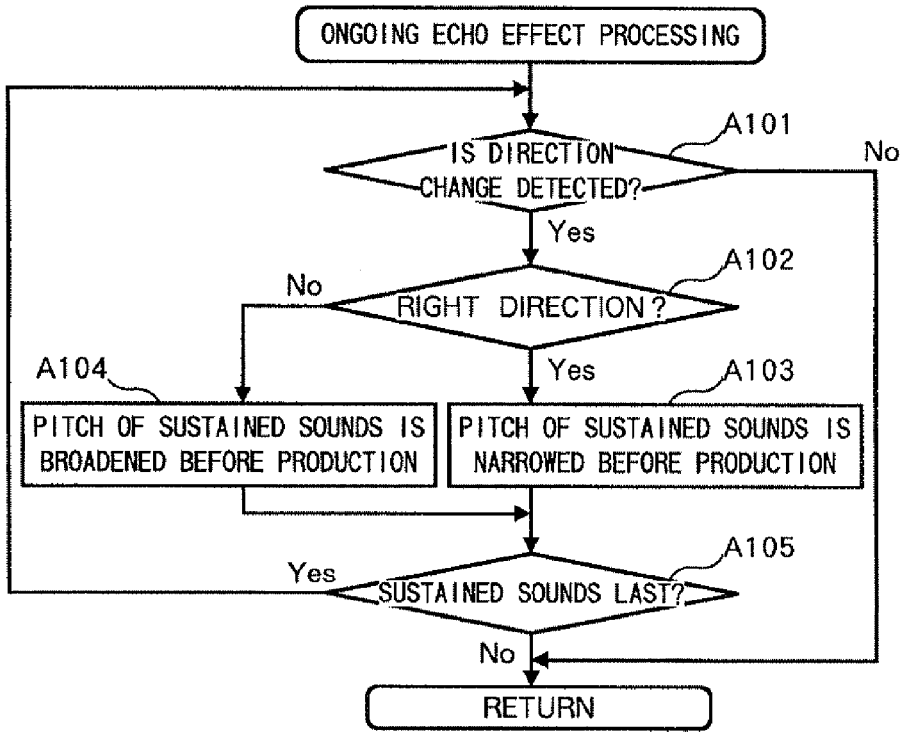
FIG. 15 is a procedure chart for ongoing echo effect processing.

For example, FIGS. 14(*a*) to (*d*) show examples where the stylus pen and the like is moved in the downward direction and then moved in the lateral direction. FIGS. 14(*e*) to (*h*) show examples where it is moved in the upward direction and then moved in the lateral direction. The procedure for the processing by the control unit 40 under such operations is as shown in FIG. 15. More specifically, when the change in direction of operation of the stylus pen and the like is detected (A101: Yes), and if it is in the right direction (A102: Yes), the pitch of the sustained sounds is narrowed before the production (A103). This slightly raises the frequency of the sustained sounds. On the other hand, if the change in direction is in the left direction (A102: No), the pitch of the sustained sounds is broadened before the production (A104). This slightly lowers the frequency of the sustained sounds. The aforementioned procedures are continued as long as the sustained sounds last (A105: Yes). As a result, even on an acoustic guitar, vibrato on an electric guitar can be produced, which expands the range of operation.

Figure 16:
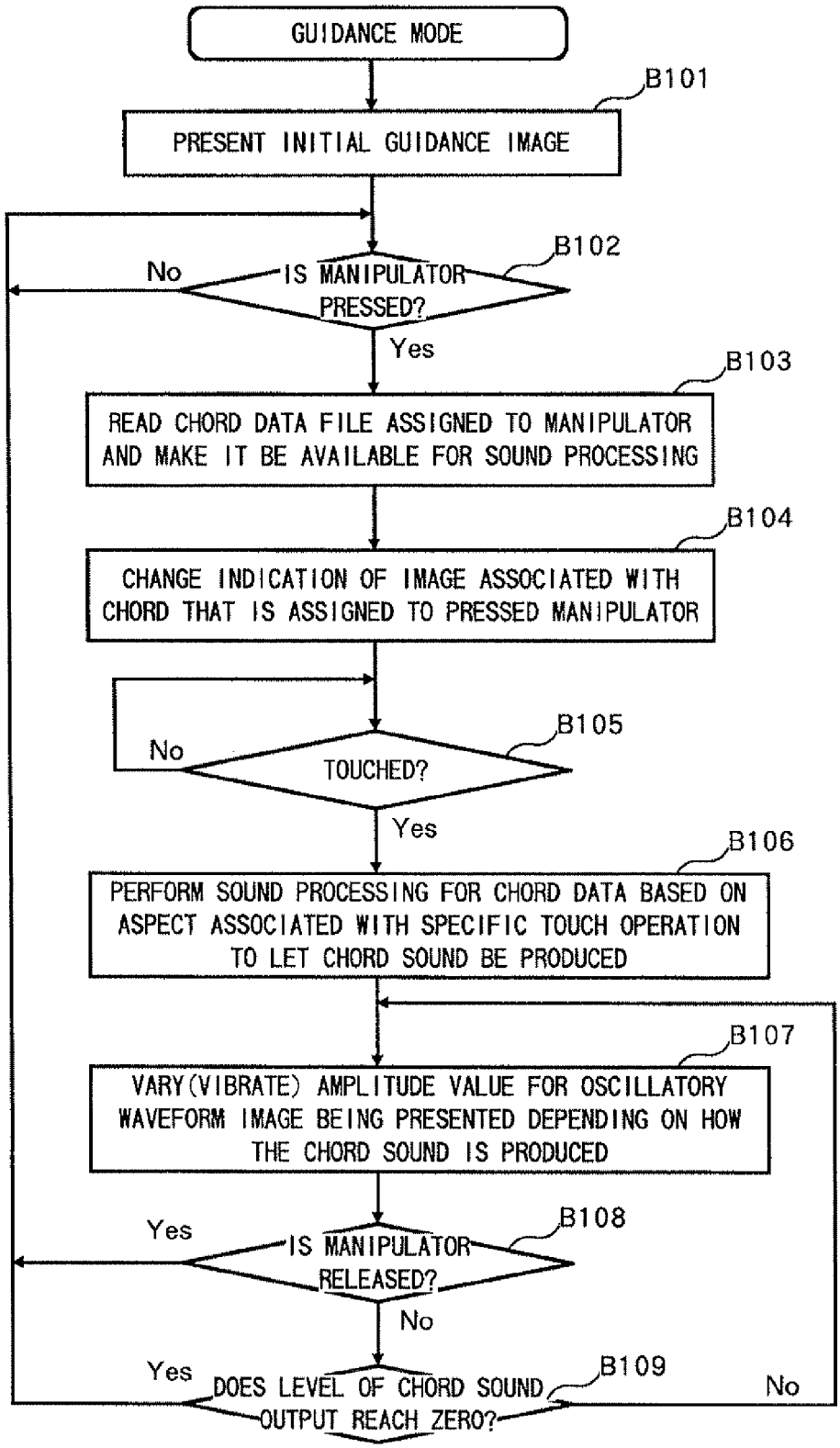
FIG. 16 is a procedure chart in a guidance mode.

Next, referring to FIG. 16, an operation procedure for the guidance mode is described.

When the guidance mode is selected, an initial guidance image is presented (B101). The initial guidance image is an image obtained by replacing the vibration image 51 in FIG. 5 with the initial vibration image 50 shown in FIG. 3(*a*), and is provided by means of sending the aforementioned data value "11" to the display controller 47.

Upon sensing a certain manipulator is pressed (B102: Yes), the control unit 40 reads the chord data file assigned to the manipulator as in the case of the oscillatory waveform mode and makes it be available for the sound processing (B103). In addition, the indication of the image associated with the chord that is assigned to the pressed manipulator is changed (B104).

For example, as shown in FIG. 5, the indication is changed so that the pressed manipulator becomes more noticeable than the other unpressed manipulators in order to allow a user to visually distinguish the pressed manipulator.

The remaining operations are similar to those in the case of the oscillatory waveform mode. More specifically, upon sensing the touch operation (B105: Yes), the sound processing for the chord data is performed in a manner that is associated with the specific touch operation to let the chord sound be produced (B106). In addition, the amplitude value for the oscillatory waveform image being presented is varied (vibrated) depending on how the chord sound is produced (B107). When the manipulator is released, the process goes back to the step B102 (B108: Yes). If the manipulator is not released (B108: No), the process at and after the step B107 is repeated (B109: No) until the level of the chord sound output reaches zero. When the level of the chord sound output reaches zero, the process goes back to the step B102 (B109: Yes). This guidance mode facilitates the operation because operation can be done while looking at the manipulator image 63 and the guide image 64 for the chord guide.

Figure 17:
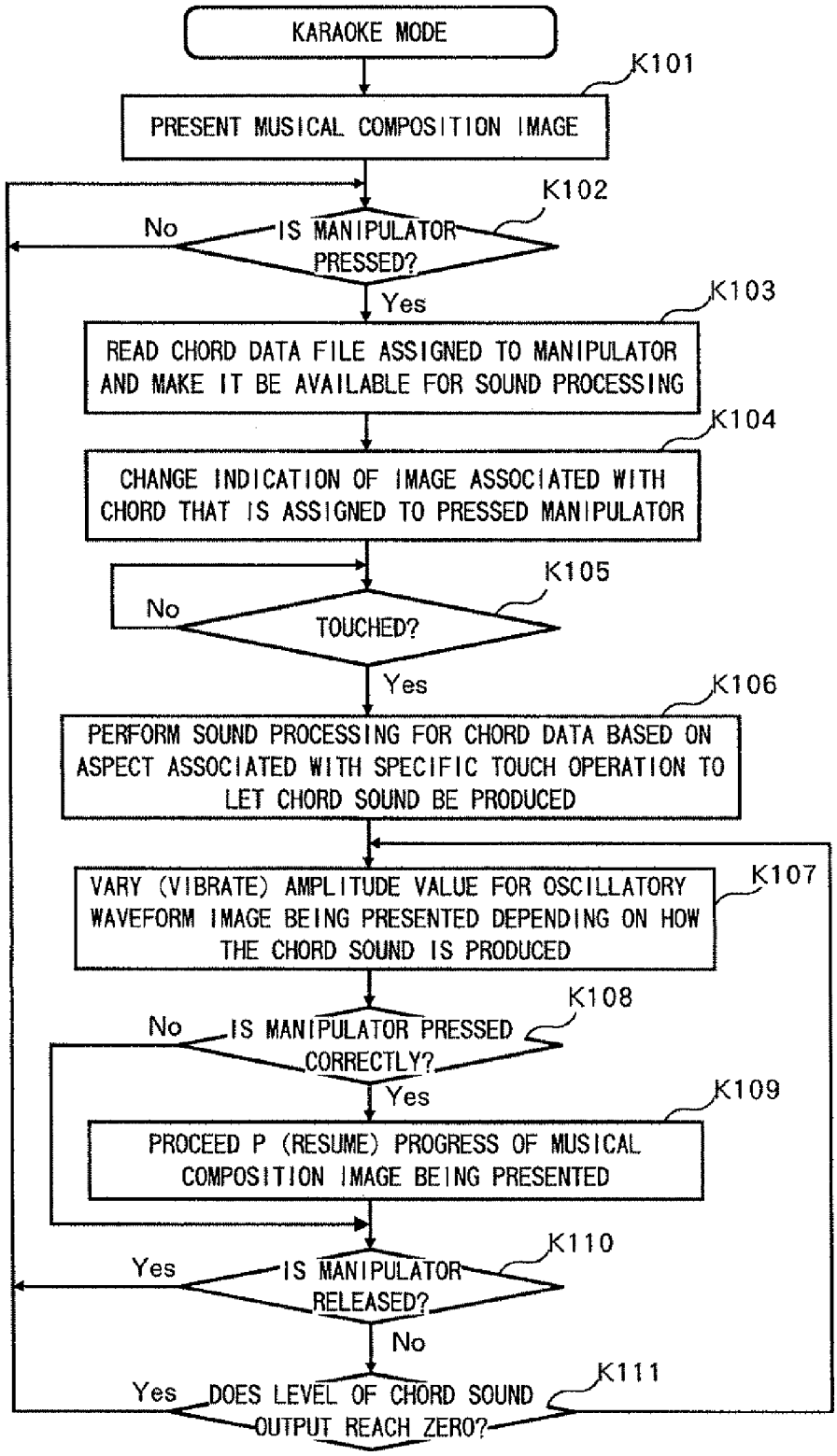
FIG. 17 is a procedure chart in a karaoke mode.
Figure 18:
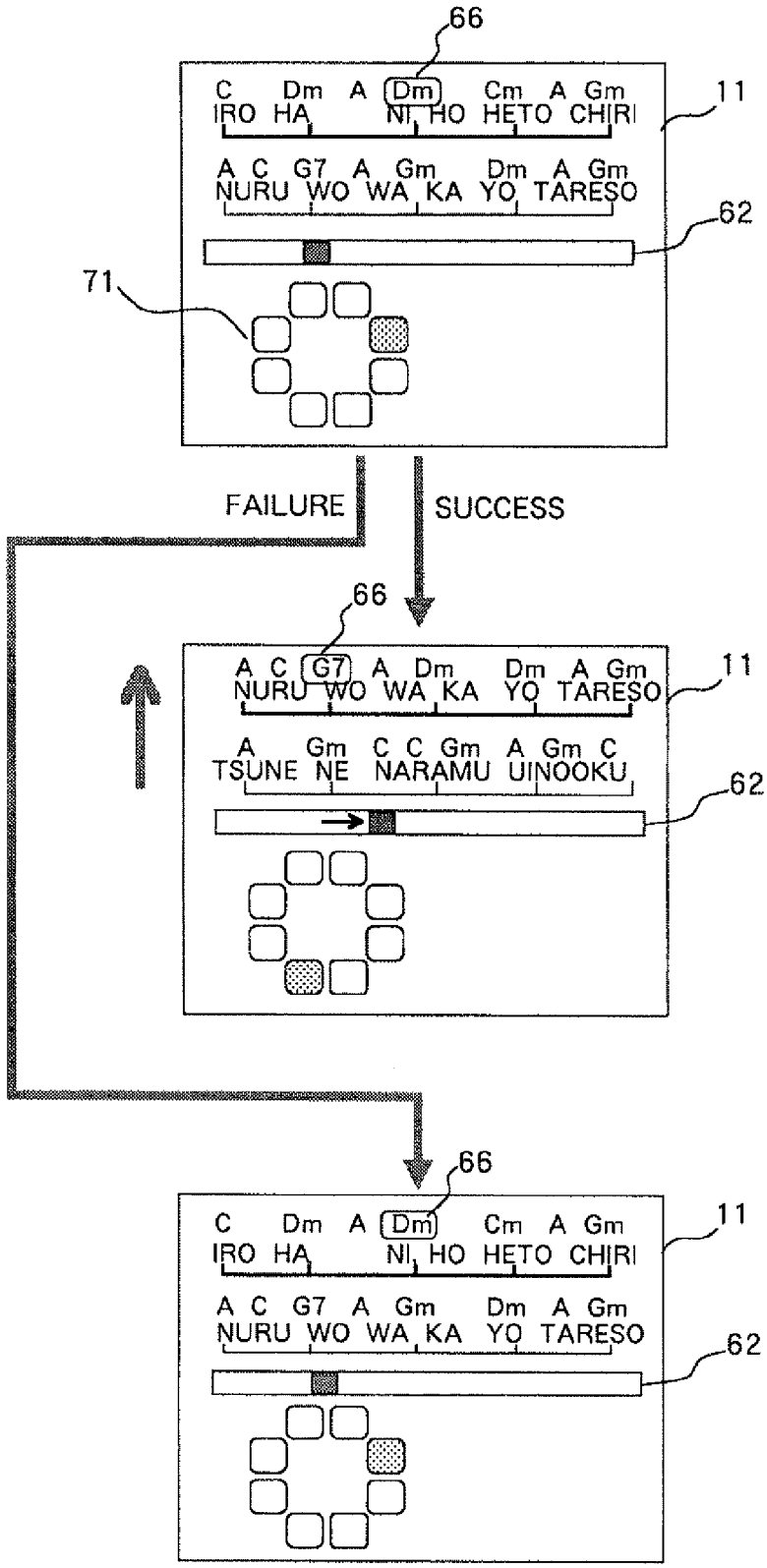
FIG. 18 is a view showing a difference in screens presented when succeeded and when failed in a karaoke mode.

Next, referring to FIGS. 17 and 18, an operation procedure for the karaoke mode is described.

When the karaoke mode is selected, the musical composition image is presented (K101). The musical composition image may be, for example, as shown in FIG. 4. Upon sensing a certain manipulator is pressed (K102: Yes), the chord data file assigned to the manipulator is read as in the case of the oscillatory waveform mode, and is made available for the sound processing (K103). In addition, as in the case of the guidance mode, the indication of the image associated with the chord that is assigned to the pressed manipulator is changed (K104).

When touched (K105: Yes), the sound processing for the chord data is performed in a manner that is associated with the specific touch operation to let the chord sound be produced (K106). In addition, the amplitude value for the oscillatory waveform image being presented is varied (vibrated) depending on how the chord sound is produced.

It is determined whether the manipulator is pressed correctly by the player (K108). This determination is made by means of, for example, checking the match between the output for a chord symbol indication (current chord symbol indication 66 in FIG. 4) and the chord ID assigned to the pressed manipulator. If pressed correctly, the progress of the musical composition image being presented proceeds (K108: Yes, K109). On the other hand, if not pressed correctly, the process at K109 is bypassed (K108: No). When the manipulator is released, the process goes back to the step K102 (K110: Yes). If the manipulator is not released (K110: No), the process at and after the step K107 is repeated (K111: No) until the level of the chord sound output reaches zero. When the level of the chord sound output reaches zero, the process goes back to the step K102 (K111: Yes).

In the image presented on the display screen 11 after the aforementioned process, the musical composition image proceeds in a predetermined direction when the chord can be specified correctly. The current position on the progress bar 62 is varied depending on the status. When you want to sing slowly, it is enough to perform touch operations while specifying chords slowly. This makes it possible to conduct music for player's purpose rather than in a device-driven manner. On the other hand, wrong operation does not cause the musical composition image to proceed, so that the player can easily find where he or she made a mistake. For example, when the player correctly operates the chord symbol indication 66 to be operated (succeed) as in the case where the musical composition image is like the upper portion of FIG. 18 (in which the guide image 64 is omitted), the measure proceeds as shown in the middle portion of FIG. 18. On the other hand, when the chord is not specified according to the chord symbol indication 66 (failure), the musical composition image does not proceed.

Figure 19:
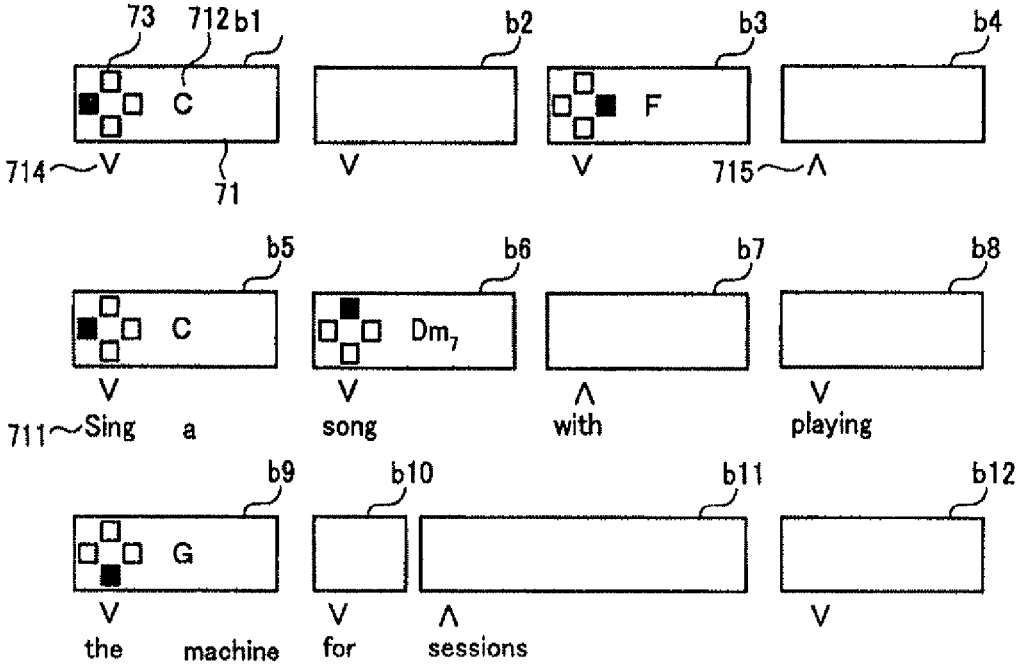
FIG. 19 shows an example of a display image on a display screen 11 presented when both mix and cross-fade are used depending on directions of operation for a manipulator by using a plurality of channels.

FIG. 19 shows an example of a display image on the display screen 11 presented when both mix and cross-fade are used depending on directions of operation for a manipulator by using a plurality of channels in the aforementioned example. The musical composition image is made up of, for example, bars 71 each having the length indicating the time interval between a given touch operation and a next touch operation (in the figure, individual bars 71 are represented as b1, b2, b12) and manipulator images 73 for the chord guide. A lyric 711 and a chord symbol indicator 722 are provided inappropriate areas in each bar 71. In addition, a timing symbol (represented by v in the figure) 714 indicating the touch operation in the downward direction and a timing symbol (represented by an inverted v in the figure) 715 indicating the touch operation in the upward direction are also presented.

Each bar 71 in FIG. 19 has the length that indicates the time interval between a given touch operation and a next touch operation. Accordingly, a user can easily find the timing at which the touch operation should be performed and the direction of the touch operation (the direction of strokes on a real guitar), through the visual presentation by using the length of the bar 71 and the timing symbol (s). In the example shown in FIG. 17, the touch operation is performed downward at same intervals from b1 to b9. The touch operation is performed upward at the head of bars b4 and b7, and downward at the head of other bars. Since the length of the bar b10 is half the length of each of the bars b1 to b9, and the inverted v is given as the timing symbol at the head of the bar 11, the touch operation is performed in the downward direction at the head of the bar b10 and then the touch operation is performed in the upward direction after the elapse of the time that is half the past time. Since the bar b11 has a length 1.5 times as long as those of the bars b1 to b9, and the v is given as the timing symbol at the head of the bar b12, the touch operation is performed in the downward direction after the elapse of the time that is 1.5 times longer than the time for the bars b1 to b9.

Although the example shown in FIG. 4 is an example where an 8-way button is used as the manipulator, this example uses a plus button as the manipulators for the chord producing device and is presented as a manipulator image 73. The bar b1 indicates that the chord C is selected by means of pressing the left of the manipulator (left of the plus button). Likewise, the bar b3 indicates that the chord F is selected by means of pressing the right of the manipulator. The bar b6 indicates that the chord Dm7 is selected by means of pressing the top of the manipulator (top of the plus button). The bar b9 indicates that the chord G is selected by means of pressing the bottom of the manipulator (bottom of the plus button). The manipulator image 73 is not given in the remaining bars, which indicates that the previously-shown button is kept pressed. For example, in b2, the left portion of the manipulator that is pressed in b1 is kept pressed because the manipulator image 73 in b1 indicates that the left portion of the manipulator is pressed.

These indications clearly tell the user the timing at which the touch operation is performed (strum with a stroke on a guitar), the direction of a stroke, and the manipulator to be pressed. In addition, each bar is associated with the chord symbol indication 712, the manipulator 73, and lyrics data like the measured ID in the example shown in FIG. 4. Furthermore, each chord symbol indication 712 is associated with the chord ID which is used to identify the chord in question.

The musical composition image is selectively rendered into the VRAM 462 by, for example, the GPU 452 and is presented on the second display pane 11*b* through the display controller 47.

[History Management]

The control unit 40 has a function to track the steps a player takes. This function is mainly effective for the karaoke mode. More specifically, a progress log that keeps track of changing the presentation of the musical composition image, a selection log that keeps track of which manipulator is selected for the presentation of the musical composition image and a touch operation log that keeps track of a player's touch to the display screen 11 are mutually associated and recorded on the EEPROM 22. The information recorded on the EEPROM 22 can be reproduced anytime in response to, for example, an instruction from the player. For example, the progress log for the musical composition image can be reproduced by means of, for example, supplying it to the GPU 452. The manipulator selection log and the touch operation log can be reproduced by means of sending them to the SPU 44. This function is used when, for example, the player confirms the current capacity of his or her device or uses it as an "automatic karaoke".

In addition, when a play is reproduced by using the operation log, the chord symbol indication 612 in FIG. 4 or the chord symbol indication 712 in FIG. 17 may be presented on the display screen 11 during the play. Furthermore, the manipulator image 63 in FIG. 4 or the manipulator image 73 in FIG. 17 may be presented.

This makes it possible to check the chords) being played during the reproduction and which button of the manipulator is pressed during recording.

As apparent from the above, the chord producing device according to this embodiment is the size to be held with one hand and thus can be carried to anywhere. Upon usage, for example, a chord sound is produced when the player holds the housing 10 with his or her left hand, operates the operation switch 121 with his or her left finger, and touch it with his or her right hand or a stylus pen. This is very easy and not always requires skill. In addition, the player can operate it at his or her own pace rather than being device-driven, so that the player can sing slowly or at a quick tempo depending on the mood at a given time. It is easy to play the device and sing a song at the same time.

A beginner can operate it even when he or she has not learned the chords by means of, for example, selecting the guidance mode or the karaoke mode. The chord sounds are produced based on the actual timbres of a real musical instrument. Therefore, beginners and skilled players both can enjoy in their own way.

[Modified Version]

The present invention is not limited to the aforementioned embodiment example. Instead, various modifications can be made in configuration. For example, the control unit 40 may be configured to detect, as operations, the position of the touch operation as well as the timing to start touching, the direction of the touch operation, and the touch operation speed. More specifically, a chord symbol indication and a chord ID are previously assigned to a predetermined position of the touch operation. Then, it may be configured to function like the pressing operation for the operation switch 121 when a player selects a position of the chord symbol indication on the display screen 11.

In this embodiment, a wrong operation will also produce a chord sound in the karaoke mode. However, the corresponding chord sound may not be produced upon the wrong operation. This makes it possible to immediately determine any wrong operation.

In this embodiment, the vibration image and the like is presented on the first display pane 11*a* while the musical composition image and the like is presented on the second display pane 11*b*. However, these display panes may be changed appropriately. In addition, in this embodiment, the first display pane 11*a* and the second pane 11*b* are switched to provide a single display screen 11. However two display screens may be provided and one of the first display pane 11*a* and the second pane 11*b* may be provided on either one of these display screens, and another one of the first display pane 11*a* and the second pane 11*b* may be provided on the other one of these display screens.

The present invention can also be applied to cases where chord sounds that simulate timbres of other musical instruments than a guitar, such as a piano are produced.

The invention claimed is:

1. A portable chord producing device having a housing of a portable size to be held with one hand, the housing having a plurality of manipulators formed thereon each of which can be selected by a player with his or her finger of one hand, and a touch sensor formed therein or thereon which can be touched by the player directly with his or her finger of the other hand or indirectly, said housing including a data memory, a control mechanism, a sound production mechanism, which are connected to each other, said data memory having a plurality of chord data files recorded thereon along with chord IDs for use in identifying chord sounds, the chord data files being for producing chord sounds that have characteristics of sounds on real a musical instrument, through said sound production mechanism, either one of said chord IDs being assigned to each of said plurality of manipulators, said control mechanism comprising:

manipulator selection state detection means for detecting which manipulator is being selected by the player and when he or she cancels the selection;

specific operation detection means for detecting details of the operation including the timing to start touching said touch sensor; and chord production control means for reading the chord data file identified by said chord ID that is assigned to the manipulator detected by said manipulator selection state detection means, from said data memory only during the time when the subject manipulator is selected, for supplying the chord data file to said sound production mechanism, and for letting the chord sound that is made producible as a result of it be produced through said sound production mechanism in a manner that is associated with the details of the operation detected by said specific operation detection means, said specific operation detection means being for detecting, in addition to said timing to start touching, a direction of the touch operation to said touch sensor, said chord production control means also being for producing, when said specific operation detection means detects that said touch sensor is touched again after a first chord sound is produced through said sound production mechanism in a manner that is associated with said details of the operation, a chord sound that is made producible by said chord ID that is assigned to the manipulator detected in said situation of operation at the time of re-touch, as a second chord sound through said sound production mechanism in a manner that is associated with said details of the operation, and for comparing said first chord sound with said second chord sound, and comparing a direction of the touch operation in said first chord sound with a direction of the touch operation in said second chord sound, for changing, in association with the results of the of these comparisons, the volume of the first chord sound that is produced in a manner that is associated with said details of the operation, the time during which the sound is produced, and the volume of the second chord sound that is produced in a manner that is associated with said details of the operation.

2. The portable chord producing device as claimed in claim 1, wherein said specific operation detection means is for detecting, in addition to said timing to start touching, at least one of a direction of the touch operation to said touch sensor, a touch operation speed, and a touch operation position, said chord production control means for changing an output frequency thereof depending on the change direction when a change in direction of the touch operation is detected for letting an output intensity thereof have an intensity for the touch operation speed when the touch operation speed is detected.

3. The portable chord producing device as claimed in claim 1, wherein said specific operation detection means is for letting the first chord sound that is produced in a manner that is associated with said details of the operation be synthesized for the production with the second chord sound produced in a manner that is associated with said details of the operation when said first chord sound is identical to said second chord sound, and when the direction of the touch operation in said first chord sound is opposite to the direction of the touch operation in said second chord sound, and in other cases, for lowering the first chord sound produced in a manner that is associated with said details of the operation from the time point of said re-touch, for letting the sound disappear over a predetermined period of time, for letting the second chord sound produced in a manner that is associated with said details of the operation have the minimum volume at the time point of said re-touch, and thereafter increase the volume thereof over a predetermined period of time to produce it.

4. The portable chord producing device as claimed in claim 1, wherein said chord data file is a data file obtained by means of recording chord sounds on a real musical instrument.

5. The portable chord producing device as claimed in claim 4, wherein said real musical instrument is a stringed musical instrument on which said chord sound is produced when a plurality of strings are strummed almost together.

6. The portable chord producing device as claimed in claim 5, comprising a memory loading-and-unloading mechanism for use in removably connecting said data memory to said control mechanism and the sound production mechanism, said data memory recording said data files for each real musical instrument including said stringed musical instrument.

7. The portable chord producing device as claimed in claim 6, wherein said data memory has an image data for use in presenting a musical composition consisting of a series of measures, each measure being associated with one or a plurality of said chord IDs that are assigned for the subject real musical instrument, said control mechanism further comprising display control means for letting a musical composition image for one or a plurality of measures to be presented on a predetermined image display pane according to the image data for use in presenting said musical composition, and for letting a next musical composition image including one or a plurality of measures be presented on said image display pane in place of the musical composition image being presented when the chord data file identified on the basis of said chord ID that is associated with measure(s) of the musical composition image being presented is produced through said sound production mechanism, said control mechanism conducting change of presentation of the musical composition images on said image display pane in response to the selection of said manipulator and operation of said touch sensor by a player.

8. The portable chord producing device as claimed in claim 7, wherein the musical composition image presented on said image display pane accompanies at least one of a lyric of the subject musical composition, information which guides the timing of operating said touch sensor for producing a chord sound, and information which guides the generation of a chord sound on said musical instrument, which are assigned to the subject one or a plurality of measures.

9. The portable chord producing device as claimed in claim 8, wherein said control mechanism further comprises history recording means for recording a progress log that keeps track of changing the presentation of said musical composition image, a selection log that keeps track of which said manipulator is selected for the presentation of said musical composition image, and a touch operation log for said touch sensor, in a mutually associated manner, said control mechanism being adapted to supply, in response to the input of an instruction from a player, said progress log out of the information recorded on said history recording means to said display control means, thereby to cause said display control means to reproduce the change in presentation of the musical composition image on said image display pane, and supply said selection log and said touch operation log to said chord production control means, thereby to cause said chord production control means to reproduce the production of a chord sound associated with said change in presentation and change in aspect thereof.

10. The portable chord producing device as claimed in claim 7, wherein said data memory has a vibration image data recorded thereon that is for representing a sound vibration image, said control mechanism further comprising vibration image display control means for letting a vibration image file that is read from said data memory be presented on a vibration image display pane which is different from said image display pane, for changing the vibration image being presented according to the production of said chord sound, and for stopping it at the time point when the output intensity reaches zero.

11. A computer program stored in a computer which is mounted in a housing of a portable size to be held with one hand for causing the computer to operate as a portable chord producing device, said housing having a plurality of manipulators formed thereon each of which can be selected by a player with his or her finger of one hand, and a touch sensor formed therein or thereon which can be touched by the player directly with his or her finger of the other hand or indirectly, said computer being provided with a data memory and a sound production mechanism, said data memory having a plurality of chord data files recorded thereon along with chord IDs for use in identifying chord sounds, the chord data file being for producing chord sounds that have characteristics of sounds on a real musical instrument, through said sound production mechanism, said computer program causing said computer to work as:

assigning means for assigning either one of said chord IDs to each of said plurality of manipulators;

manipulator selection state detection means for detecting which manipulator is being selected by the player and when he or she cancels the selection;

specific operation detection means for detecting details of the operation including the timing to start touching said touch sensor and a direction of the touch operation to said touch sensor; and chord production control means for reading the chord data file identified by said chord ID that is assigned to the manipulator detected by said manipulator selection state detection means, from said data memory only during the time when the subject manipulator is selected, to for supplying it to said sound production mechanism, and for letting the chord sound that is made producible as a result of it be produced through said sound production mechanism in a manner that is associated with the details of the operation detected by said specific operation detection means, as well as to for producing, when said specific operation detection means detects that said touch sensor is touched again after a first chord sound is produced through said sound production mechanism in a manner that is associated with said details of the operation, a chord sound that is made producible by said chord ID that is assigned to the manipulator detected in said situation of operation at the time of re-touch, as a second chord sound through said sound production mechanism in a manner that is associated with said details of the operation, and for comparing said first chord sound with said second chord sound, and comparing a direction of the touch operation in said first chord sound with a direction of the touch operation in said second chord sound, for changing, in association with the results of these comparisons, the volume of the first chord sound that is produced in a manner that is associated with said details of the operation, the time during which the sound is produced, and the volume of the second chord sound that is produced in a manner that is associated with said details of the operation.

12. A computer readable recording medium on which a computer program as claimed in claim 11 is recorded.

* * * * *